US007254364B2

(12) United States Patent
Nakayama

(10) Patent No.: US 7,254,364 B2
(45) Date of Patent: Aug. 7, 2007

(54) CLEANING BLADE FOR AN IMAGE FORMING APPARATUS FEATURING A SUPPORTING PORTION AND A CLEANING PORTION HAVING SPECIFIED HARDNESS AND FRICTION PROPERTIES FOR THE PORTIONS

(75) Inventor: Yuji Nakayama, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 32 days.

(21) Appl. No.: 10/851,182

(22) Filed: May 24, 2004

(65) Prior Publication Data

US 2004/0240915 A1 Dec. 2, 2004

(30) Foreign Application Priority Data

May 26, 2003 (JP) ..... 2003-148428

(51) Int. Cl.
*G03G 21/00* (2006.01)

(52) U.S. Cl. ..... 399/345; 399/350

(58) Field of Classification Search ..... 399/345, 399/350

See application file for complete search history.

(56) References Cited

U.S. PATENT DOCUMENTS

| | | | | |
|---|---|---|---|---|
| 4,264,191 | A * | 4/1981 | Gerbasi et al. | 399/350 X |
| 4,823,161 | A * | 4/1989 | Yamada et al. | 399/350 |
| 5,258,816 | A * | 11/1993 | Haneda et al. | 399/345 X |
| 5,521,691 | A * | 5/1996 | Morimoto et al. | 399/350 |
| 5,671,464 | A * | 9/1997 | Kubota | 399/101 |
| 5,907,746 | A * | 5/1999 | Kubota | 399/101 |
| 6,055,404 | A | 4/2000 | Yamazaki et al. | 399/350 |
| 6,311,037 | B1 | 10/2001 | Hisakuni et al. | 399/350 |
| 6,473,589 | B2 * | 10/2002 | Hisakuni | 399/350 |
| 6,522,856 | B2 | 2/2003 | Nakayama | 399/297 |
| 6,704,539 | B2 | 3/2004 | Nakayama | 399/350 |
| 2002/0028100 | A1 * | 3/2002 | Kubo et al. | 399/350 |
| 2003/0081971 | A1 * | 5/2003 | Nakayama | 399/350 |

FOREIGN PATENT DOCUMENTS

| | | | |
|---|---|---|---|
| EP | 1 302 819 A2 | * | 4/2003 |
| JP | 56-55979 | | 5/1981 |
| JP | 9-218625 | | 8/1997 |
| JP | 2001-343874 | * | 12/2001 |
| JP | 2003-122213 | * | 4/2003 |

* cited by examiner

*Primary Examiner*—Sandra L. Brase
(74) *Attorney, Agent, or Firm*—Fitzpatrick, Cella, Harper & Scinto

(57) ABSTRACT

An image forming apparatus includes an image bearing member on which a toner image is formed and a blade retained so as to be capable of coming into contact with and separating from the image bearing member and adapted, when in contact with the image bearing member, to remove residual toner remaining on the image bearing member after image transfer, the blade being brought into contact with or separated from the image bearing member during movement of the image bearing member, wherein the blade includes an edge portion to be brought into contact with the image bearing member and a support portion causing the edge portion to come into contact with the image bearing member, and wherein the hardness of the edge portion is higher than the hardness of the support portion, the hardness of the edge portion being not less than 75 degrees but not more than 100 degrees (JIS-A), the hardness of the support portion being not less than 60 degrees but not more than 85 degrees (JIS-A).

6 Claims, 6 Drawing Sheets

CLEANING BLADE FOR AN IMAGE FORMING APPARATUS FEATURING A SUPPORTING PORTION AND A CLEANING PORTION HAVING SPECIFIED HARDNESS AND FRICTION PROPERTIES FOR THE PORTIONS

BACKGROUND OF THE INVENTION

1. Field of the Invention

The present invention relates to an image forming apparatus such as a copier or printer. More specifically, the present invention relates to an image forming apparatus provided with a member for cleaning toner remaining on an image bearing member after transferring a toner image to a transfer incurring material.

2. Related Background Art

Heretofore, for example, in an image forming apparatus of an electrophotographic process, an electrostatic latent image in accordance with image information is formed on an electrophotographic photosensitive member (hereinafter, referred to as a "photosensitive member") as an image bearing member, developing means supplies toner (a developer) to the photosensitive member in accordance with this electrostatic latent image, and thus a toner image (a developer image) is formed. Then, this toner image is finally transferred to a transferring material, for example, to a recording sheet, an OHP sheet, or the like, followed by fixing, and thus a permanent image is obtained.

Among color image forming apparatuses using the electrophotographic process, there is one in which toner images of different colors are sequentially formed on a single photosensitive member and these toner images are transferred to a transferring material, or the toner images are transferred to an intermediate transfer member sequentially in an overlapping manner and then collectively transferred to the transferring material, followed by fixing, thus obtaining a color image. Moreover, there is one, in which toner images of colors different from one another are formed on a plurality of photosensitive members and these toner images are transferred to the transferring material, or the toner images are transferred to the intermediate transfer member sequentially in an overlapping manner and collectively transferred to the transferring material, followed by fixing, thus obtaining a color image.

In these days, as such an image forming apparatus of the electrophotographic process, a multiple function machine combining all output terminals such as a copier, a printer, and a fax machine have come to be widely accepted in the market. As such a network-capable output terminal, the electrophotographic process has been widely accepted; however, a duty cycle of a main body of the apparatus has come to be cited as one problem. The duty cycle means the limit number of image recording sheets up to which the main body of the apparatus continues to operate normally without any maintenance by a service person. The life of the photosensitive member is cited as the greatest rate-determining factor of the duty cycle.

Moreover, from the viewpoint of ecology, it is required that waste be eliminated, that is, it is required that consumables be reduced, that the life of the consumables be extended, and that the reliability be enhanced.

Furthermore, digitization of the image forming apparatus has progressed from a conventional analog apparatus, and it is required that the main body of the apparatus be equivalent or less in cost to the analog apparatus. Heretofore, in the copier and the printer, monochrome machines have been the mainstream; however, in recent years, the demand for full color image formation of originals or output files has increased dramatically even in offices. Accordingly, there is a demand for a full-color image forming apparatus which, in addition to being a digital apparatus equivalent to the analog machine in cost, is equivalent to monochrome machines in terms of the cost of the main body thereof and running cost. For this purpose, a technology capable of remarkably lowering TCO (Total Cost of Ownership) is desired.

Under such circumstances, an amorphous silicon photosensitive member as the image bearing member has come to be used often because hardness thereof is high (1000 $Kg/m^2$ or more in Vickers hardness according to a JIS standard), and because this amorphous silicon photosensitive member is excellent also in durability, heat resistance, and environmental stability. Particularly, in a monochrome high-speed machine for which high reliability is required, the amorphous silicon photosensitive member has come to be essential. Usually, the life of the amorphous silicon photosensitive member as represented by the number of prints necessitating replacement of the photosensitive member is more than one digit higher than that of an OPC photosensitive member. Specifically, the life of the amorphous silicon photosensitive member is equivalent to that of the main body of the apparatus, which also brings an effect of waste reduction. Furthermore, unlike a process cartridge using the OPC photosensitive member, manpower for collection and recovery thereof is not required.

If such a technology using the amorphous silicon photosensitive member mounted on the high-speed machine can be implemented on the full-color image forming apparatus, preferably, it is possible to realize an image forming apparatus which cannot only achieve the duty cycle and low running cost of the high-speed machine for a monochrome print but also carry out a color print. Particularly, for a user frequently making the monochrome print, in order to achieve the duty cycle and the low running cost which are equivalent to those of the monochrome high-speed machine, it is considered to be the most preferable to mount the amorphous silicon photosensitive member on a so-called full-color image forming apparatus of a one-drum system, which uses a rotary developing device having a plurality of developing means mounted on a rotator, and performs development on a single photosensitive member while sequentially switching among the developing means (for example, a drum-type photosensitive member).

In the image forming apparatus repeating the step of transferring a transferable toner image formed on a surface of the photosensitive member to the transferring material mainly made of paper or the intermediate transfer member, it is essential to sufficiently remove adhesion matter such as toner remaining on the photosensitive member without being transferred to a transfer incurring member during the transfer (transfer residual toner) whenever such adhesion matter is generated.

For this reason, many proposals have been made concerning cleaning means for the photosensitive member (for example, in Japanese Patent Application laid-Open Nos. S56-55979 and H9-2 18625). Among them, one which scrapes off the adhesion matter by a blade-shaped cleaning member made of an elastic material such as urethane rubber, that is, a cleaning blade, has been widely put into practical use for its simple configuration, compactness, and low cost and also for its excellent adhesion matter removing function. As a rubber material of the cleaning blade, the urethane rubber is generally used, which is high in hardness, rich in elasticity, and excellent in abrasion resistance, mechanical strength, oil resistance, and ozone resistance.

In order to extend the life of the photosensitive member and to enhance the reliability thereof from the viewpoint of achieving the duty cycle, the low running cost, and the reduction of the waste which are equivalent to those of the monochrome high-speed machine, the removal of the adhesion matters from the surface of the photosensitive member becomes a problem. It is not oniy the toner that adheres onto the surface of the photosensitive member and affects image quality. Adhesion matter (foreign matter) adhered onto the surface of the photosensitive member because of fine paper powder generated from paper used as the transferring material in almost all cases, an organic component precipitated therefrom, generation of corona occurring due to the presence of a high-pressure member in the apparatus, and the like, may cause a reduction in resistance particularly under a high-humidity environment to prevent a clear electrostatic latent image from being formed. This is considered to be the factor causing a deterioration of the image quality.

It is known that such an image deterioration phenomenon as described above is prone to occur in the case of an amorphous silicon photosensitive member which is configured to form a film by glow discharge decomposition of silanes.

In order to avoid such a defect, particularly in the case of using a one-component magnetic developer as the toner, there has been proposed one in which a magnet roller is disposed, in the cleaning device, on an upstream side of the cleaning blade as viewed in a running direction of the photosensitive member, a magnetic brush is formed by a part of toner collected by the cleaning device, the magnetic brush is brought into contact with the surface of the photosensitive member to resupply the magnetic toner thereto, and the above-mentioned variety of adhesion matter (foreign matter) are removed in a rubbing manner by means of a polishing action of toner particles in an abutting region of the cleaning blade.

As compared with a method of rubbing the surface of the image bearing member by a separately prepared polishing member such as a web and a rubber roller, the cleaning means using such a magnetic brush as described above involves less localization of the polishing action on the surface of the photosensitive member, and therefore less deformation of the surface of the photosensitive member.

Together with the polishing method using the above-described magnetic brush, there may be used auxiliary means of, for example, disposing a heater for the photosensitive member to lower humidity in a periphery thereof also at night and during standby, thereby preventing the resistance of the surface of the photosensitive member from being lowered. In such a way, a certain effect is obtained for hindering the image deterioration caused by the variety of adhesion matter as described above.

Moreover, for example, in the case of employing an intermediate transfer member in a color image forming apparatus such as a full-color image forming apparatus of the one-drum system, in order to realize the above-described duty cycle and low running cost which are equivalent to those of the monochrome high-speed machine, it is necessary to enhance the reliability of the intermediate transfer member. Here, as in the case of the above-described photosensitive member, removal of adhesion matter from a surface of the intermediate transfer member becomes a problem.

For cleaning means for removing the adhesion matter, such as the toner, which remain on the intermediate transfer member after transferring the toner image to the transferring material, many proposals have been made heretofore. Among them, as in the case of the above-described photosensitive member, one which scrapes off the adhesion matter by a blade-shaped cleaning member made of an elastic material such as the urethane rubber, that is, a cleaning blade, has been widely put into practical use for its simple configuration, compactness, and low cost and also for its excellent adhesion matter removing function. As a rubber material of the cleaning blade, the urethane rubber is generally used, which is high in hardness, rich in elasticity, and excellent in abrasion resistance, mechanical strength, oil resistance, and ozone resistance.

However, some problems are pointed out in the conventional method for cleaning the members to be cleaned in the image forming apparatus, such as the photosensitive member and the intermediate transfer member.

A problem caused by separating/abutting of the cleaning blade is posed. In the case where the degrees of adhesion and affinities between the cleaning blade and the surface of the image bearing member and between the adhesion matter on the image bearing member and the surface of the image bearing member are increased, when the cleaning blade is attached and/or detached, that is, when the cleaning blade is made to abut on the image bearing member or is separated therefrom, the speed of the intermediate transfer member becomes uneven, causing misregister of colors. Furthermore, vibrations may be applied to the image bearing member due to the wear of the blade caused by an impact given thereto when the blade is made to abut on the image bearing member or by the frictional force with the image bearing member, and the like, or due to the impact applied when the blade is made to abut thereon, causing an image failure.

SUMMARY OF THE INVENTION

Hence, in general, it is an object of the present invention to provide a cleaning member which has improved cleaning property for cleaning surfaces of members to be cleaned in an image forming apparatus, such as an electrophotographic photosensitive member and an intermediate transfer member, and which enables formation of a high-quality image over a long period of time, and to provide an image forming apparatus including the cleaning member.

It is another object of the present invention to prevent an image failure caused by an impact upon the contact of the blade with the image bearing member, the wear of the blade due to the frictional force or the like imparted by the image bearing member, or the vibrations in the image bearing member caused by the impact upon the contact of the blade with the image bearing member when the cleaning blade is attached or detached, that is, when the cleaning blade is brought into contact with or separated from the image bearing member.

The above objects can be attained by means of a cleaning member and an image forming apparatus according to the present invention. To attain the above objects, an image forming apparatus includes the following:

(1) A cleaning device including: a blade for removing toner on an image bearing member; and a retaining means for retaining the blade, wherein the blade is capable of coming into contact with and separating from the image bearing member, and wherein a hardness of a first region of the blade coming into contact with the image bearing member is higher than a hardness of a second region of the blade retained by the retaining means.

Further, as another method for attaining the above objects, there is provided:

(2) An image forming apparatus including: an image bearing member; a blade for removing toner on the image bearing member; a retaining means for retaining the blade; and a means for bringing the blade into contact with and separating the blade from the image bearing member during image formation, wherein a hardness of a first region of the blade coming into contact with the image bearing member is higher than a hardness of a second region of the blade retained by the retaining means.

Further, as still another method for attaining the above object, there is provided:

(3) An image forming apparatus including: an image bearing member; a blade for removing toner on the image bearing member; a retaining means for retaining the blade; and a means for bringing the blade into contact with and separating the blade from the image bearing member, wherein the blade is caused to abut the image bearing member in a direction counter to a moving direction of the image bearing member, wherein a dynamic coefficient of friction of a portion of the blade abutting the image bearing member with respect to polyethylene terephthalate is not more than 1.0, and wherein a surface roughness Rz of a surface of the image bearing member coming into contact with the blade is not less than 0.2 but not more than 4.0.

Further, other methods for attaining the above objects will become apparent upon reading the following description of the present invention.

DETAILED DESCRIPTION OF THE PREFERRED EMBODIMENTS

Embodiment 1

A member to be cleaned in an image forming apparatus which cleans adhesion matter by use of a cleaning member according to the present invention is typically an electrophotographic photosensitive member or an intermediate transfer member, with which an electrophotographic image forming apparatus is equipped. While the present invention will be described below by taking, as an example, the case of applying the present invention to an electrophotographic copier, the present invention is not one limited to this and widely applicable to image forming apparatuses of an electrophotographic process and electrostatic recording process.

Figure 1:
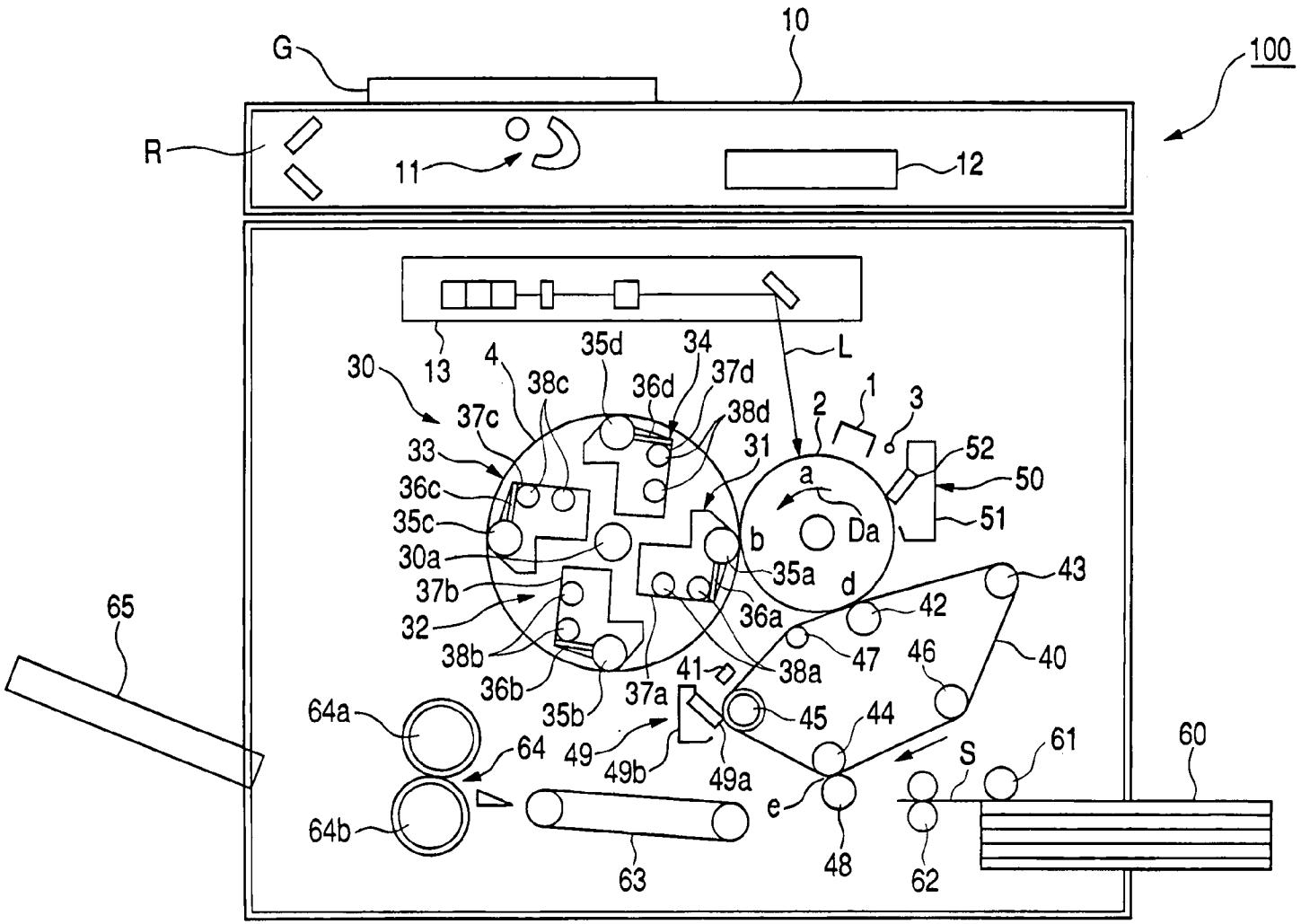
FIG. 1 is a configuration view schematically showing an example of an image forming apparatus to which the present invention can be applied.

(Entire configuration of image forming apparatus) First, an entire configuration of the image forming apparatus will be described with reference to FIG. 1. FIG. 1 shows an entire configuration of an image forming apparatus 100 of this embodiment. In this embodiment, the image forming apparatus 100 is an electrophotographic copier which can form a full-color image on a transferring material S such as, for example, a recording sheet and an OHP sheet by the electrophotographic process according to image information of a read original. Moreover, as a so-called printer, the image forming apparatus 100 can also output an image in accordance with image information transmitted from external host equipment such as a personal computer connected to a main body of the apparatus so as to be communicable therewith.

The image forming apparatus 100 of this embodiment includes an image reading means R, a drum-type photosensitive member 2 as an image bearing member, a charger 1 as a charging means, a Raster Optical Scanner (ROS: latent image writing device) 13 as an exposure means, a rotary developing device (developing unit) 30 having four developing devices 31 to 34 as a developing means on a developing roller (rotary member) 4 as a developing device supporter, a transfer means having an intermediate transfer belt 40 as an intermediate transfer member and the like, a photosensitive member cleaner 50 as a cleaning means for the photosensitive member 2, a pre-exposure device 3 as a charge eliminating means, an intermediate transfer member cleaner 49 as a cleaning means for the intermediate transfer belt 40, a fixing device 64, and a feeding/discharging system.

Each constituent component of the image forming apparatus 100 will be described below in far more detail.

The photosensitive member 2 is an image bearing member which bears a developer image (toner image) formed by supplying a developer to an electrostatic latent image formed on the photosensitive member 2. As the photosensitive member 2, an amorphous silicon photosensitive member can be used. The amorphous silicon photosensitive member is a photosensitive member having a photosensitive layer formed of a non-monocrytalline material (amorphous silicon (a-Si)) mainly formed of silicon atoms as a host. In a-Si, other atoms may be included. These other atoms include atoms sorted to the 3B group of the periodic table, such as hydrogen atoms, halogen atoms, carbon atoms, oxygen atoms, and boron atoms, and atoms sorted to the 5B group of the periodic table, such as nitrogen atoms. Moreover, it is preferable that the above-described photosensitive layer be formed of a plurality of stacked layers different in function. As examples of such a plurality of layers, a lower blocking layer, a photoconductive layer formed of a charge transport layer, a charge generation layer, and the like, a buffer layer, a surface layer, and the like, can be given.

It is more preferable that the above-described amorphous silicon photosensitive member have a surface layer formed of hydrogenated amorphous carbon on a top surface thereof from the viewpoint of improving hardness of the surface of the photosensitive member and improving lubricity of the surface of the photosensitive member. The hydrogenated amorphous carbon is one (a-C:H) in which hydrogen atoms are contained in a non-monocrytalline material mainly formed of carbon atoms as a host, and may be one containing other atoms as in the above-mentioned a-Si. Note that, while a-C:H mainly represents amorphous carbon having an intermediate property between graphite and diamond, a structure of a-C:H may partially contain microcrystal and multicrystal.

The amorphous silicon photosensitive member containing the above-described surface layer can be manufactured by a conventionally known method. As an example of such a manufacturing method, for example, a manufacturing method can be given, in which a conductive base material is placed in a system, gas for supplying atoms (material gas), which contains the above-mentioned atoms, is introduced into the system, plasma is generated in the system to decompose the material gas, and the atoms are deposited on the conductive base material. This manufacturing method includes, for example, a plasma CVD method. The film thickness and strength of the photosensitive layer formed (which includes the surface layer) can be controlled by adjusting concentration of the material gas and high-frequency power for use in discharge. The material gas may be used by being diluted in hydrogen or noble gas (inert gas).

In this embodiment, as the photosensitive member 2, an amorphous silicon photosensitive member charged with negative charges was used. The photosensitive member 2 is composed by forming an amorphous silicon photosensitive layer with a thickness of 30 μm on an aluminum cylinder with a diameter of 80 mm and a thickness of approximately 3 mm by glow discharge or the like. As the surface layer of the photosensitive member 2 in this embodiment, one obtained by stacking SiC:H (hydrogenated amorphous silicon carbide) to 8000 Å was used.

Note that polishing speed of the surface of the photosensitive member 2 per 1000 revolutions can be obtained by measuring an abrasion wear of the photosensitive member 2 after rotating the photosensitive member 2 by a predetermined number of revolutions, dividing the abrasion wear by the predetermined number of revolutions, and multiplying the divided number by 1000. A polished depth can be measured by use of by a reflection spectro-interferometer (MCDP2000 manufactured by Otsuka Electronics Co., Ltd.).

The charger 1 is a charging means for imparting charges to the outer surface of the photosensitive member 2. As this charging means, various conventionally known charging means can be used. As examples of such charging means, for example, there can be given a corona discharge charger which charges the photosensitive member with a corona discharge, a roller charger which charges the photosensitive member in a state where a conductive roller member is in contact therewith or not, a conductive brush charger which charges the photosensitive member in a state where a conductive brush is in contact therewith, a magnetic brush charger which charges the photosensitive member in a state where a magnetic brush is formed by magnetic force on a roller and in contact with the photosensitive member, and the like.

In this embodiment, as the charging means, the charger 1 of the corona discharge system was used. This charger 1 includes a discharge wire formed of tungsten or the like, and a casing of which a cross section is a U shape open toward the photosensitive member 2.

In this embodiment, as examples of an image forming means, the exposure means and the developing means can be given. Note that, when the image bearing member is an intermediate transfer member, as examples of the image forming means, an exposure means to a photosensitive drum, a developing means, and a transfer means for making a transfer to the intermediate transfer member can be given.

The exposure means is a means for forming an electrostatic latent image corresponding to a desired image on the photosensitive member 2 by applying light to the charged photosensitive member 2. As the exposure means, various conventionally known exposure means can be used. As examples of such exposure means, for example, a gas laser such as a He-Ne laser, a semiconductor laser, an LED, and an LCD can be given.

In this embodiment, the ROS (latent image writing device) 13 was used as the exposure means. The ROS 13 includes a laser generating device which generates a laser beam corresponding to a read image. On an optical path of a laser beam L, an image forming lens, a mirror, and the like are arranged appropriately.

The image reading means R includes an original table glass 10, a light source 11 which applies light toward the original table glass 10, a CCD 12 which converts reflected light from the original table glass 10 into electric signals for red ®), green (G), and blue (B), and an image processing system (IPS) (not shown) which converts the electric signals for the RGB inputted from the CCD 12 into image data of black (K), yellow (Y), magenta (M), and cyan (C), and outputs, to the laser generating device, electric signals corresponding to the converted image data.

As the developing means, a developing device using a two-component developer mainly containing resin toner particles and magnetic carrier particles can be used. Such a developing device includes a developing sleeve that is a developer bearing member freely rotatable, for example, to a direction counter to the photosensitive member 2. In this case, the developing sleeve bears the two-component developer by magnetic force, thus forming the magnetic brush. In general, with regard to the two-component developer, toner thereof does not have to contain magnetic particles. Accordingly, the developer is advantageous in forming a color image in the full-color image forming apparatus or the like. A plurality of such developing means are provided to the image forming apparatus, thus making it possible to form the full-color image.

Besides the developing sleeve mentioned above, the developing means can be configured to include a developer container which accommodates the developer, a developer regulating member which regulates the developer carried on the developing sleeve, an agitating member which agitates the developer accommodated in the developer container, and a supply means for supplying non-magnetic toner particles.

Here, in general, when the plurality of developing means are provided in the full-color image forming apparatus, a configuration may be adopted, in which one developing means is arranged for one photosensitive member, and a plurality of pairs thereof are provided. What can be given as an example of such a configuration is, for example, a configuration in which a plurality of image forming units each including the photosensitive member, the charging means, the exposure means, the transfer means, and the cleaning means are provided, a transferring material is sequentially conveyed to the plurality of transfer means of the respective units, and thus toner images are sequentially transferred to the transferring material.

Moreover, when the plurality of developing means are provided, another configuration may also be adopted, in which the plurality of developing means are used for one photosensitive member while being sequentially switched, and the developers carried on the developing sleeves provided in the respective developing means are arranged on positions where the developers can rub the photosensitive member. What can be given as an example of such a configuration is, for example, a configuration in which a photosensitive member and a freely rotatable drum-shaped rotary developing device (developing unit) having a plurality of developing means are provided, and a rotation of the developing unit arranges the plurality of developing means sequentially to the rubbing position of the photosensitive member.

No particular limitations are imposed on the developing sleeve as long as it is one which bears the two-component developer by magnetic force to form the magnetic brush, and various conventionally known configurations can be adopted. What can be given as an example of such a developing sleeve is, for example, a configuration including a non-magnetic and conductive rotary sleeve formed of aluminum, stainless steel, or the like, and magnetic field generating means such as a magnet having a plurality of magnetic poles and being fixed to the inside of the rotary sleeve.

Figure 2:
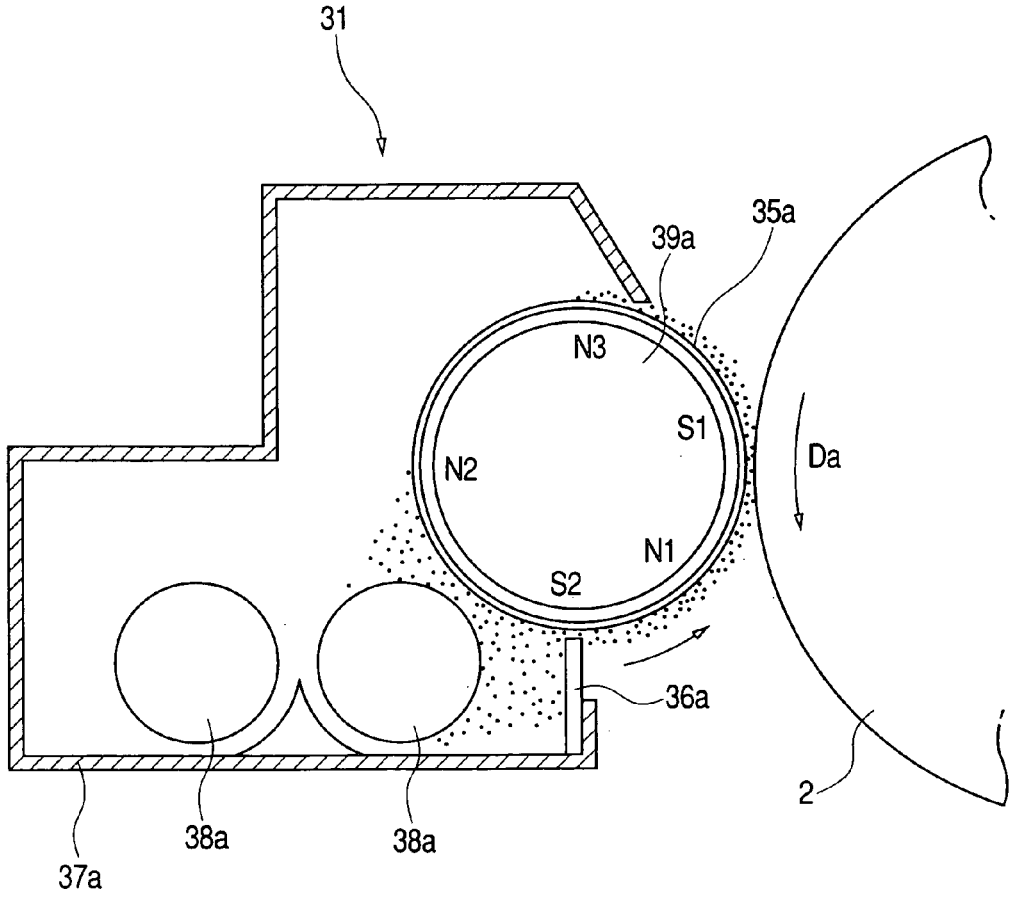
FIG. 2 is a cross-sectional view schematically showing a developing device included in the image forming apparatus of FIG. 1.

In this embodiment, the rotary developing device in which the four developing devices 31 to 34 as the plurality of developing means are provided in the developing roller 4 is used. As shown in FIG. 2, for example, the developing device 31 includes a developer container 37*a* which accommodates a two-component developer of black (K), a developing sleeve 35*a* provided in an opening of the developing container 37*a* so as to be freely rotatable, a regulating blade 36*a* which regulates the developer to be carried on the developing sleeve 35*a* and regulates a height of the magnetic brush formed on the developing sleeve 35*a*, a rotary rod 38*a* for agitating the developer in the developer container 37*a*, and a power supply (not shown) which applies a voltage to the developing sleeve 35*a* at the time of development. To the inside of the developing sleeve 35*a*, a magnet member 39*a* as a magnetic field generating means having the plurality of magnetic poles is fixed. The magnet member is magnetized in a predetermined pattern where a pole N2, a pole S2, a pole N1, a pole Si, and a pole N3 are arrayed on an outer circumference thereof along a rotational direction of the developing sleeve 35*a*. In this embodiment, the pole N2 is a pumping pole which pumps up, at a position thereof, the developer in the developer container 37*a* to the developing sleeve 35*a*, and the pole Si is a main developing pole which performs the development at a position thereof by bringing the developer into contact with the photosensitive member 2. Moreover, the poles N3 and N2 adjacent to each other form a repulsive magnetic field, and operate to return the developer on the developing sleeve 35*a* to the developer container 37*a*.

A yellow (Y) developer is accommodated in the developing device 32, a magenta (M) developer is accommodated in the developing device 33, and a cyan (C) developer is accommodated in the developing device 34. These developing devices are configured similarly to the developing device 31 for black (K) other than the developers accommodated therein. In FIG. 1, with regard to the respective developing devices 32, 33, and 34 for yellow, magenta, and cyan, the same reference numerals imparted with subindices of b, c, and d, respectively, are added to components corresponding to the developer container 37*a*, the developing sleeve 35*a*, and the regulating blade 36*a*.

The developing devices 31 to 34 are provided in the freely rotatable developing roller 4. The developing roller 4 is a rotary member which has a rotating shaft 30*a* and rotates to convey the developing devices 31 to 34 corresponding to color data of the electrostatic latent image to a developing region B at the time of development. The developing roller 4 constitutes the rotary developing means (rotary developing device) 30. By this developing roller 4, the developing sleeves 35*a* to 35*d* are arranged so that regions thereof closest to the photosensitive member 2 have gaps of approximately 400 μm with the photosensitive member 2 at least at the time of development. Then, the developing sleeves 35*a* to 35*d* are arranged so as to be capable of developing the electrostatic latent image in a state where the magnetic brushes thereon are brought into contact with the photosensitive member 2.

The transfer means is a means for transferring the toner image formed on the photosensitive member to the transferring material. As the transfer means, various conventionally known transfer means can be used; however, a transfer means of an electrostatic transfer system is more preferable. As examples of such transfer means, for example, a corona transfer device and a bias roller transfer device can be given.

Moreover, the transfer means is not limited to a means for directly transferring the toner image from the photosensitive member to the transferring material, and a transfer means for transferring the toner image from the photosensitive member through the intermediate transfer member to the transferring material can also be suitably used. In this case, the intermediate transfer member functions as the image bearing member. As an example of such transfer means, for example, there can be given a configuration including an intermediate transfer member to which the toner image of the photosensitive member is transferred, the intermediate transfer member being disposed to contact the photosensitive member, a primary transfer means (first transfer means) for transferring the toner image on the photosensitive member to the intermediate transfer member, and a secondary transfer means (second transfer means) for transferring the toner mage from the intermediate transfer member as the image bearing member, the secondary transfer means being disposed to contact the intermediate transfer member. Note that, as examples of the intermediate transfer member, a roller-shaped transfer means, a belt-shaped transfer means, and the like can be given.

In the case where the plurality of developing means are provided and the above-described intermediate transfer member is used, a configuration may be adopted, in which the respective toner images formed by the developing means are transferred to the intermediate transfer member, and the toner images are transferred to the transferring material by the secondary transfer means at every transfer. Alternatively, another configuration may also be adopted, in which the toner images formed by the developing means are transferred to the intermediate transfer member from the photosensitive member so as to entirely overlap each other, and the toner images are then collectively transferred from the intermediate transfer member to the transferring material by the operation of the secondary transfer means. When the intermediate transfer member is not used, a configuration may be used, in which toner images of a plurality of different colors are developed on the photosensitive member in a manner of image-on-image, and are then collectively transferred to the transferring material.

It is preferable that the transfer means of the electrostatic transfer system, such as the intermediate transfer member, be composed of a member having proper surface and volume resistance values. As an example of the member having such resistance values, for example, a resin member containing conductive fine particles such as carbon black can be given. The resistance values can be controlled by adjusting a type and content of the conductive fine particles. As examples of the resin member, silicon rubber, urethane rubber, ethylene propylen dien monomer (EPDM) and the like, and foams thereof can be given. As examples of the belt member, polyimide resin, polycatbonate, fluororesin such as PVDF can be given.

Moreover, it is preferable the surface layer of the intermediate transfer member be formed of a material rich in releasing property in order to improve the releasing property of the transferred toner. As examples of such a material, there can be given fluororesins such as tetrafluoroethylene (TFE), hexafluoropropylene copolymer (FEP), and perfluoroalkoxy resin (PFA).

Here, it is preferable that a Young's modulus of the intermediate transfer member be $2.5\times10^3$ MPa or more from the viewpoint of formation of a high-quality image, durability, and cleaning characteristics. When the Young's modulus of the intermediate transfer member is less than $2.5\times10^3$ MPa, it becomes necessary to wrap the belt member around a pair of rollers holding and rotating the belt member. More preferably, the Young's modulus is set to $3.0\times10^3$ MPa. In addition, usually, the Young's modulus of the intermediate transfer member is $10.0\times10^3$ MPa or less, which results from a usable material.

Moreover, there is a fear that the intermediate member may rupture by the endurance before an assumed life thereof if a tensile strength thereof is less then 1000 N/cm, and more specifically, less than 500 N/cm. Hence, from the viewpoint of the reliability, it is preferable that the tensile strength be set to 1000 N/cm or more, and more preferably, 2000 N/cm or more. In addition, a polymer compound such as polyimide resin with a film thickness of approximately 100 μm is used for the intermediate transfer member, and accordingly, the tensile strength thereof is usually restricted to 10,000 N/cm or less.

From such points as described above, as the material of the intermediate transfer member, such resin of polyimide having high Young's modulus/tensile strength is preferable.

Moreover, in this case, it is preferable that the surface roughness Rz of the intermediate transfer member be 0.2 or more and 4.0 or less. If the surface roughness Rz exceeds 4.0, a cleaning failure may sometimes occur. Meanwhile, if the surface roughness is less than 0.2, the frictional forces among the cleaning blade (to be described later), the intermediate transfer member, and the residual toner are undesirably increased, and the chipping and curling of the cleaning blade becomes apt to occur.

In this embodiment, below the photosensitive member 2, there are provided the intermediate transfer belt 40 as the intermediate transfer member, a plurality of belt-support rollers including a belt drive roller 45, a tension roller 43, idler rollers 46 and 47, and a back-up roller 44 for the secondary transfer, a primary transfer roller 42 as the primary transfer means, a belt frame (not shown) which supports these, and the intermediate transfer member cleaner 49 including a blade-type cleaning member (cleaning blade) as the cleaning means for removing the adhesion matter (residual toner and the like) adhered onto the intermediate transfer belt 40 before the transfer. Moreover, the intermediate transfer belt 40 is supported by the belt-support rollers so as to be rotationally movable.

At a position spaced apart from the intermediate transfer belt 40, a belt position sensor 41 which detects a home position provided on a non-transfer portion of the intermediate transfer belt is provided. Moreover, at a position opposite to the back-up roller 44 for the secondary transfer with the intermediate transfer belt 40 interposed therebetween, a secondary transfer roller 48 as the secondary transfer means for transferring the toner image on the intermediate transfer belt 40 to the transfer material S such as a recording sheet is provided.

In this embodiment, the intermediate transfer belt 40 is formed of polyimide resin. This intermediate transfer belt 40 is manufactured as follows. In producing a thermosetting seamless belt with a base layer having carbon black dispersed therein, carbon black is mixed with a polyimide varnish U for heat resistant film manufactured by Ube Industries, Ltd. by means of a mixer or the like. An undiluted solution thus obtained is poured into a cylindrical mold and undergoes centrifugal molding while being heated. The material is released in a semi-cured state, and then the released belt is wrapped around an iron core and is heated at 400° C. to 450° C. for final curing (imidizing reaction), thereby obtaining a seamless belt having a surface specific resistance of $10^{10}$ Ω/□, a volume resistivity of $10^9$ Ω·cm, and a thickness of 75 μm. Due to the surface roughness of the inner surface of the cylindrical mold, the surface roughness Rz (10-point average roughness: JIS B 0601) of the intermediate transfer belt 40 is adjusted to 0.5. The coefficient of friction of the intermediate transfer belt 40 was 0.17 (HEIDON tribogear muse TYPE: 94B).

The secondary transfer back-up roller 44 serving as the support roller for the intermediate transfer belt 40 and as the opposing electrode of the secondary transferring roller 48 may have a single layer or a multi-layer construction. In the case of a single layer, it is formed of a roller in which an appropriate amount of conductive fine powder, such as carbon black, is mixed with silicone rubber, urethane rubber, ethylene propylene diene monomer (EPDM). A secondary transfer back-up roller 44 of double-layer construction is composed of a core layer formed of a foam material with appropriately adjusted volume resistivity, such as silicone rubber, urethane rubber, or ethylene propylene diene monomer (EPDM), and a skin layer formed on the outer peripheral surface thereof and consisting of a material obtained by mixing a conductive agent such as carbon black with conductive silicone rubber, urethane rubber, ethylene propylene diene monomer (EPDM) or the like. From the viewpoint of transfer property, it is preferable for the volume resistivity of the secondary transfer back-up roller 44 to range from $10^2$ Ω·cm to $10^9$ Ω·cm.

There are no particular limitations regarding the layer construction of the secondary transferring roller 48; for example, in the case of a double-layer construction, it is composed of a core layer and a coating layer covering the surface thereof. The core layer is formed of silicone rubber, urethane rubber, ethylene propylene diene monomer (EPDM), or the like with conductive powder dispersed therein, or a foam material thereof. The coating layer is preferably formed of a fluororesin type material with conductive powder dispersed therein. Examples of the fluororesin include tetrafluoroethylene (TFE), hexafluoropropylene copolymer (FEP), and perfluoroalkoxy resin (PFA). From the viewpoint of transfer characteristic, it is preferable for the volume resistivity of the secondary transferring roller 48 to range from $10^6$ Ω·cm to $10^9$ Ω·cm.

The cleaning means for the photosensitive member is a means for removing toner remaining on the photosensitive member after primary transfer. While it is possible to use various conventionally known cleaning means, it is preferable to adopt a cleaning means (photosensitive member cleaner) having as the cleaning member an elastic blade (cleaning blade) formed of urethane or the like and adapted to come into contact with the photosensitive member.

To remove toner without damaging the surface of the photosensitive member, it is preferable for the cleaning blade used in the photosensitive member cleaner to have an appropriate degree of hardness. Further, it is preferable for the cleaning blade to have an appropriate degree of resilience since that would help prevent toner from slipping through and to absorb fine vibration generated from friction with the photosensitive member. Further, for long service life due to wear resistance, it is preferable for the cleaning blade to have an appropriate degree of modulus. These physical properties of the cleaning blade are measured by measuring methods as defined by JIS.

In this embodiment, the photosensitive member cleaner 50 serving as the cleaning means for the photosensitive member 2 has a cleaning blade 52 held in contact with the surface of the photosensitive member 2 and a cleaning container 51 holding the cleaning blade 52 and accommodating toner particles, etc. removed from the photosensitive member 2 by the cleaning blade 52. The cleaning blade 52 is in contact with the photosensitive member 2 in the counter direction, that is, such that its distal end is directed to the upstream side with respect to the moving direction of the surface of the photosensitive member 2. The photosensitive member cleaner 50 will be described in more detail below with reference to a specific example.

Further, it is preferable for the image forming apparatus to have a charge eliminating means to remove an electrostatic latent image remaining on the photosensitive member 2 after the cleaning of the photosensitive member 2 by the photosensitive member cleaner 50. It is possible to employ various conventionally known charge eliminating means; for example, as a means for canceling a residual electrostatic latent image by applying light to the photosensitive member after cleaning, it is possible to use a gas laser, a semiconductor laser, an LED, an LCD, or the like.

In this embodiment, a pre-exposure device 3 is provided as such a charge eliminating means. The pre-exposure device 3 is a light emitting diode (device GaAlAs) whose peak wavelength is mainly 660 nm. In the pre-exposure device 3, the half-value width corresponding to ½ of the peak wavelength is approximately 25 nm, and the exposure amount is 20 $\mu J/cm^2$ The time it takes the surface of the photosensitive member 2 to move from the pre-exposure device 3 to the charger 1 is approximately 50 mm·sec.

As the cleaning means for cleaning the intermediate transfer member after secondary transfer, it is possible to use various cleaning means conventionally known as the cleaning means for the photosensitive member; it is preferable to employ, as the cleaning member, a cleaning means (intermediate transfer member cleaner) formed of urethane or the like and having an elastic blade (cleaning blade) held in contact with the intermediate transfer member.

To remove toner without damaging the surface of the intermediate transfer member, it is preferable for the cleaning blade used in the intermediate transfer member cleaning member to have an appropriate degree of hardness. Further, as in the case of the photosensitive member cleaner described above, it is preferable for the cleaning blade used in the intermediate transfer member cleaner to have an appropriate degree of resilience since that would help prevent toner from slipping and absorb fine vibration generated through friction with the intermediate transfer member. Further, from the viewpoint of long service life due to wear resistance, it is preferable for this cleaning blade to have an appropriate degree of modulus. These physical properties regarding the cleaning blade are measured by measuring methods as defined in JIS.

In this embodiment, the intermediate transfer member cleaner 49 serving as the cleaning means for the intermediate transfer belt 40 has a cleaning blade 49*a* held in contact with the surface of the intermediate transfer member and a cleaning container 49*b* holding the cleaning blade 49*a* and accommodating toner particles, etc. removed from the intermediate transfer belt 40 by the cleaning blade 49*a*. The cleaning blade 49*a* is in contact with the intermediate transfer belt 40 in the counter direction, that is, such that its distal end is directed to the upstream side with respect to the moving direction of the surface of the intermediate transfer belt 40. The intermediate transfer member cleaner 49 will be described in more detail below with reference to a specific example.

Further, in this embodiment, the fixing device 64 has a heating roller 64*a* and a pressurizing roller 64*b* opposed to this heating roller 46*a*.

Further, the above-mentioned sheet feeding/discharging system with which the image forming apparatus of this embodiment is equipped has a tray 60 accommodating transferring materials (recording sheets) S, a pick-up roller 61 for extracting the recording sheets in the tray 60 one by one, a registration roller pair 62 for conveying the transferring materials S in synchronism to the secondary transferring roller 48, a sheet conveying belt 63 for conveying the transferring materials S which have undergone secondary transfer of toner images toward the fixing device 64, and a discharge tray 65 onto which the transferring materials S with images fixed thereto by the fixing device 64 are discharged.

Next, a two-component developer that can be used in the image forming apparatus of this embodiment will be described.

A two-component developer is provided at least with non-magnetic toner particles and magnetic carriers. As the non-magnetic toner particles, ones that are substantially spherical may be used. The configuration of the non-magnetic toner particles can be confirmed through observation by an electron microscope or the like; to maintain a high transfer efficiency, it is preferable for the non-magnetic toner particles to be toner particles having a substantially spherical shape with a configuration coefficient SF-1 of 100 to 140 and a configuration coefficient SF-2 of 100 to 120. By using toner particles having configuration coefficients in the above ranges, it is possible to constantly ensure a primary transfer efficiency of 95% or more.

The above-mentioned SF-1 and SF-2 can be defined by the following equations using the toner particle projection area, toner particle absolute maximum length, and toner particle peripheral length of a non-magnetic toner particle image (such as electron microscope photograph):

$$SF-1 = \frac{(MXLNG)^2}{\text{AREA}} \times \frac{\pi}{4} \times 100$$

$$SF-2 = \frac{(PERI)^2}{\text{AREA}} \times \frac{1}{4\pi} \times 100$$

(where AREA is toner projection area, MXLNG is absolute maximum length, and PERI is peripheral length)

The configuration coefficients SF-1 and SF-2 can be obtained by obtaining an image in non-magnetic toner particles, performing sampling on an appropriate number of toner particles in the image, analyzing the toner particle image that has undergone sampling, and substituting the obtained values into the above equations for calculation. More specifically, the configuration coefficients SF-1 and SF-2 are obtained by randomly sampling 100 toner particles by means of a scanning type electron microscope FE-SEM (S-800) manufactured by Hitachi, Ltd., introducing the image information into an image analysis apparatus (Luzex 3) manufactured by Nireco Corporation through an interface for analysis, and performing calculation by the above equations.

To obtain a satisfactory image, it is preferable for the non-magnetic toner particles to have a weight average particle size of 6 to 10 μm. When the weight average particle size exceeds the above range, the resolution suffers, making it sometimes impossible to form a clear, high-quality image. On the other hand, when the weight average particle size is below the above range, the adhesion force and cohesion force become stronger than the electrostatic force, which leads to various troubles.

The weight average particle size of the non-magnetic toner particles can be measured by various methods, such as sieving, sedimentation method, or photon correlation method; here, the measurement was performed by using the measuring apparatus COULTER Multisizer™ (manufactured by COULTER K. K.). The measurement method is as follows.

By using special class or first class sodium chloride, an aqueous solution of 1% NaCl was prepared (e.g., ISOTO N-II manufactured by Coulter Scientific Japan Co. was used), and 0.1 to 5 mL of a surface active agent, preferably, alkyl benzene sulfonate, was added as a dispersing agent to 100 to 150 mL of this electrolytic aqueous solution, and, further, 2 to 20 mg of toner constituting the measurement specimen was added thereto; the electrolytic solution with the specimen suspended therein was subjected to dispersion process for approximately 1 to 3 minutes by an ultrasonic dispersion apparatus, and, using a 100 μm aperture, the volume and number of toner particles were measured for calculation of the volume distribution and number distribution. Then, by obtaining the weight average particle size from this volume distribution (using the center value of each channel as the representative value of each channel), it is possible to measure the weight average particle size of the non-magnetic toner particles.

The non-magnetic toner particles can be manufactured by a conventionally known method. The non-magnetic toner particles can be manufactured by the pulverizing method, in which the component materials are uniformalized by heating and melting, cooling and solidifying the resultant material before pulverizing the same. Generally speaking, however, the toner particles obtained by the pulverizing method are indefinite in shape, so that to obtain a substantially spherical particle configuration, it is necessary to perform thereon a mechanical, thermal or some other special processing; to attain a weight average particle size in the above-mentioned range, it is necessary to perform classification on the toner particles after sphericalization. In view of this, it is preferable to adopt a polymerization method as the method of manufacturing the non-magnetic toner particles.

There are various known methods of manufacturing polymerized toner; examples of such methods include emulsion polymerization method, soapfree emulsion polymerization method, two-step swelling polymerization method, dispersion polymerization method, and suspension polymerization method. In the case in which toner particles with a desired particle size are to be manufactured in one step of the polymerization reaction, the two-step swelling polymerization method, dispersion polymerization method, and suspension polymerization method are superior, and, from the viewpoint of simplicity in process, product quality, etc., the suspension polymerization method is still superior.

The suspension polymerization method is a manufacturing method suitable for manufacturing the non-magnetic toner particles to be used in the present invention. In the suspension polymerization method, an oily material constituting toner particles is charged into an aqueous dispersion medium containing an appropriate dispersion medium to form monomer type droplet particles, and, in this state, the monomer type particles are polymerized to produce toner particles. As the materials constituting the toner particles, the monomer type particles include, for example, polymeric monomer, coloring agent, and, as needed, other additives, such as polymerization initiator, crosslinking agent, releasing agent, plasticizer, and charge control agent.

To achieve a sharp particle size distribution of the toner particles obtained, it is preferable to achieve at a stroke a desired toner particle size by using a high speed dispersion apparatus, such as a high speed agitator or ultrasonic dispersion apparatus, at the time of suspension. The polymerization initiator may be added to the monomer particles simultaneously with the other additives, or it may be added to the monomer type material or the aqueous dispersion medium before or after the granulation of the droplet particles; in this case, the polymerization initiator may be added by dissolving it in the monomer type material or an appropriate solvent.

After the granulation through polymerization of the monomer type material, the particulate state is maintained by using an ordinary agitator, and the agitation is performed to such a degree as to prevent floating or settling of the particles.

After the completion of the polymerization, non-magnetic toner particles can be obtained by performing filtration, washing, and drying by well-known methods. It is also a preferable mode of manufacturing non-magnetic toner particles to add a classification process to the manufacturing process to cut rough powder or fine powder. Further, in the classification process, the obtained toner particles can be classified into predetermined particle sizes, making it possible to prepare toner particles of a desired particle size distribution by mixing toner particles with different particle sizes.

Various conventionally known polymeric monomers may be used as the above-mentioned polymeric monomers. Examples of such polymeric monomers include: styrene; styrene derivatives such as o-methylstyrene, m-methylstyrene, p-methylstyrene, p-phenylstyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, p-chlorostyrene, 3,4-dichlorostyrene, m-nitrostyrene, o-nitrostyrene, and p-nitrostyrene; unsaturated monoolefins such as ethylene, propylene, butylene, and isobutylene; unsaturated diolefins such as butadiene and isoprene; vinyl halides such as vinyl chloride, vinylidene chloride, vinyl bromide, and vinyl fluoride; vinyl esters such as vinyl acetate, vinyl propionate, and vinyl benzoate; methacrylic acid and α-methylene aliphatic monocarboxylates such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, and phenyl methacrylate; arcylic acid and acrylates such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate, and pheyl acrylate; maleic acid and maleic acid half ester; vinyl ethers such as vinyl methyl ether, vinyl ethyl ether, and vinyl isobutyl ether; vinyl ketones such as vinyl methyl ketone, vinyl hexyl ketone, and methyl isopropenyl ketone; N-vinyl compounds such as N-vinylpyrrole, N-vinylcarbazole, N-vinylindole, and N-vinylpyrrolidone; vinylnaphthalenes; acrylate or methacrylate derivatives such as acrylonitrile, methacrylonitrile, and acrylamide; and acroleins. One or two or more of those may be used.

Various conventionally known coloring agents may be used in the above-mentioned coloring agent, and yellow, cyan, magenta, and black dyes and pigments may be used when forming a full-color image.

Examples of the yellow coloring agent include: C.I Pigment Yellow 1, 2, 3, 4, 5, 6, 7, 10, 11, 12, 13, 14, 15, 16, 17, 23, 65, 73, and 83; and C.I Vat yellow 1, 3, and 20.

Examples of the cyan coloring agent include: C.I Pigment Blue 2, 3, 15, 16, and 17; C.I. Vat Blue 6; C.I. Acid Blue 45; and copper phthalocyanine pigments each having a phthalocyanine skeleton substituted by 1 to 5 phthalimidemethyl groups.

Examples of the magenta coloring agent include: magenta pigments such as C.I Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 49, 50, 51, 52, 53, 54, 55, 57, 58, 60, 63, 64, 68, 81, 83, 88, 89, 90, 112, 114, 122, 123, 163, 202, 206, 207, and 209, C.I. Pigment Violet 19, and C.I. Vat Red 1, 2, 10, 13, 15, 23, 29, and 35; oil soluble dyes such as C.I. Solvent Red 1, 3, 8, 23, 24, 25, 27, 30, 49, 81, 82, 83, 84, 100, 109, and 121, C.I. Disperse Red 9, and C.I. Solvent Violet 8, 13, 14, 21, and 27, C.I. and Disperse Violet Red 1; and basic dyes such as C.I. Basic Red 1, 2, 9, 12, 13, 14, 15, 17, 18, 22, 23, 24, 27, 29, 32, 34, 35, 36, 37, 38, 39, and 40, and C.I. Basic Violet 1, 3, 7, 10, 14, 15, 21, 25, 26, 27, and 28.

Examples of the black coloring agent include carbon black.

Various conventionally known polymerization initiators may be used as the above-mentioned polymerization initiators. Examples of such polymerization initiators include di-t-butyl peroxide, benzoyl peroxide, lauroyl peroxide, t-butyl peroxylaurate, 2,2'-azobisisobutyronitrile, 1,1-bis(t-butylperoxy)3,3,5-trimethylcyclohexane, 1,1-bis(t-butylperoxy)cyclohexane, 1,4-bis(t-butylperoxycarbonyl)cyclohexane, 2,2-bis(t-butylperoxy)octane, n-butyl-4,4-bis(t-butylperoxy)valirate, 2,2-bis(t-butylperoxy)butane, 1,3-bis (t-butylperoxyisopropyl)benzene, 2,5-dimethyl-2,5-di(t-butylperoxy)hexane, 2,5-dimethyl-2,5-di(benzoylperoxy) hexane, di-t-butyl peroxyisophthalate, 2,2-bis-(4,4-di-t-butylperoxycyclohexyl)propane, di-t-butylperoxy-α-methyl succinate, di-t-butylperoxy dimethyl glutarate, di-t-butylperoxy hexahydroterephthalate, di-t-butylperoxy azelate, diethylene glycol-bis(t-butylperoxycarbonate), di-t-butylperoxy trimethyl adipate, triazine, vinyltris(t-butylperoxy) triazine, vinyltris(t-butylperoxy)silane, cumin perpivalate, dicumyl perpxide, azobis-isobutyronitrile, and dimethylazoisobutyrate.

Various conventionally known crosslinking agents may be used as the above-mentioned crosslinking agents. Examples of such crosslinking agents include divinylbenzene, divinylnaphthalene, bis(4-acryloxypolyethoxyphenyl) propane, ethylene glycol diacrylate, 1,3-butylene glycol diacrylate, 1,4-butylene glycol diacrylate, 1,5-pentanediol diacrylate, 1,6-hexanediol diacrylate, neopentyl glycol diacrylate, diethylene glycol diacrylate, triethylene glycol diacrylate, tetraethylene glycol diacrylate, diacrylates of polyethylene glycol #200, #400, and #600, dipropylene glycol diacrylate, polypropylene glycol diacrylate, polyester-type diacrylates (MANDA, Nippon Kayaku Co., Ltd.), and those obtained by changing the "acrylate" of the above to "methacrylate").

Waxes are employed as the releasing agent and the platicizer. Generally speaking, as the releasing agent, one with high melting point and low solubility with respect to polymeric monomer is preferably selected. As the plasticizer, one with low melting point and high solubility with respect to polymeric monomer is preferably selected. The melting point can be judged by measuring glass transition point, and the solubility with respect to polymeric monomer can be judged, for example, by the dispersion state (e.g., whether it becomes whitish or not) when dispersed in the polymeric monomer.

Examples of waxes that may be used as the releasing agents and plasticizers include: a paraffin wax and derivatives thereof; a montan wax and derivatives thereof; a microcrystalline wax and derivatives thereof; a Fischer-Tropsch wax and derivatives thereof; and a polyolefin wax and derivatives thereof. Oxides, block copolymers with vinyl monomers, and graft modified bodies are included in the derivatives. Examples of the polyolefin wax include: single polymers and copolymers of linear-chain-α-olefins and branch-α-olefins such as ethylene, propylene, butene, pentene, hexene, heptene, octene, nonene, and decene; alcohols, fatty acids; acid amides; esters; ketones; curing caster oil and derivatives thereof; plant waxes; animal waxes; mineral waxes; and petrolactam.

Various conventionally known negative and positive charge control agents may be used as the above-mentioned charge control agent.

Organometallic compounds and chelate compounds are effective as charge control agents that control the toner particles to negative charges. Examples thereof include: monozaometallic compounds; acetylacetone metallic compounds; metallic compounds of aromatic hydroxy carboxylates and of aromatic dicarboxylates; aromatic hydroxy carboxylic acids, aromatic mono and polycarboxylic acids and metallic salts, anhydrides, and esters thereof; phenol derivatives such as bisphenol; urea derivatives; metal-containing salicylic acid compounds; metal-containing naphthoic acid compounds; boron compounds; quaternary ammonium salt; calixarene; silicon compounds; styrene-acrylate copolymers; styrene-methacrylate copolymers; styrene-acrylic-sulfonate copolymers; and non-metal carboxylate compounds.

Examples of charge control agents that control the toner particles to positive charges include: materials modified by nigrosine and fatty acid metallic salts; guanidine compounds; imidazole compounds; tributylbenzylammonium-1-hydroxy-4-naphthosulfonate; quaternary ammonium salts such as tetrabutylammoniumtetrafluoroborate, and onium salts such as phosphonium salt which are analogs thereof, and lake pigments thereof; triphenylmethane dyes and lake pigments thereof (examples of lake activating agents include phosphotungstic acid, phosphomolybdic acid, phosphotungsten molybdic acid, tannic acid, lauric acid, gallic acid, ferricyanides, and ferrocyanide); metallic salts of higher fatty acids; diorganotin oxides such as dibutyltin oxide, dioctyltin oxide, and dicyclohexyltin oxide; and diorganotin borates such as dibutyltin borate, dioctyltin borate, and dicyclohexyltin borate. Those may be used separately or two or more types thereof may also be used in combination.

Although the above-mentioned other additives are not particularly limited, for example, in order to control physical properties of toner particles, those chosen from various resin compounds may be given. More specifically, non-vinyl condensation resins such as a polyester resin, epoxy resin, phenol resin, urea resin, polyurethane resin, polyimide resin, cellulose resin, and polyether resin, and mixtures thereof with binder resins, etc. may be given.

The above-mentioned aqueous dispersion medium is a medium mainly composed of water. Specific examples of the aqueous dispersion medium include: water itself; water with a small amount of surface-active agent added; water with a pH adjuster added; and water with an organic solvent added. Preferable as the surface-active agent is a non-ionic surface-active agent such as polyvinyl alcohol. Preferable as the pH adjuster is an inorganic acid such as hydrochloric acid.

The above-mentioned dispersion stabilizer is used to achieve satisfactory granulation in the aqueous dispersion medium and various conventionally known dispersion stabilizers may be used as the dispersion stabilizer. Examples of such a dispersion stabilizer include: inorganic compounds such as tricalcium phosphate, magnesium phosphate, aluminum phosphate, zinc phosphate, calcium carbonate, magnesium carbonate, calcium hydroxide, magnesium hydroxide, aluminum hydroxide, calcium metasilicate, calcium sulfate, barium sulfate, bentonite, silica, and alumina; organic compounds such as polyvinyl alcohol, gelatin, methylcellulose, methylhydroxypropylcellulose, ethylcellulose, carboxymethylcellulose and sodium salts thereof, polyacrylic acid and salts thereof, and starch; and surface-active agents such as sodium dodecylbenzene sulfate, sodium tetradecyl sulfate, sodium pentadecyl sulfate, sodium octyl sulfate, sodium oleate, sodium laurate, potassium stearate, and calcium oleate.

Further, it is preferable for the non-magnetic toner particles to have a specific gravity of 1.3 g/cm$^3$ or less. When the specific gravity of the toner particles greatly exceeds 1.4 g/cm$^3$, the share applied to the toner particles increases, which is unpreferable since that leads to a deterioration in the toner particles. The specific gravity of the toner particles can be adjusted by the kind of material used (specific gravity), the mixing amount thereof, etc.; it can be measured by various measurement methods by using a measurement apparatus, such as Accupyc 1330 manufactured by Shimadzu Corporation.

Apart from the above-mentioned non-magnetic toner particles, the two-component developer contains at least magnetic carriers. There are no particular limitations regarding the magnetic carriers as long as they carry the non-magnetic toner to form a magnetic brush on the developing sleeve, and it is possible to employ various conventionally known magnetic carriers.

While the magnetic carriers may be a magnetic substance adjusted to a desired particle size, it is possible, in the present invention, to preferably employ magnetic substance dispersion type magnetic carriers in which magnetic substance is dispersed in resin. With the magnetic substance dispersion type carriers, the magnetic force, electrical resistance, particle size, etc. can be freely adjusted, and the specific gravity can be reduced; further, it is possible to obtain a wide variety of characteristics through material selection and proportion adjustment, so that the magnetic substance dispersion type carriers are suitable as carriers for high image quality.

The magnetic substance dispersion type carriers can be manufactured by a method similar to the polymerization method described above; as the resin, it is possible to employ, for example, a resin formed by the polymerization of a polymeric monomer as mentioned above, a mixture consisting of the resin and a resin compound mentioned as the other additives, or a copolymer. Further, it is possible to employ, as needed, various materials mentioned for the non-magnetic toner particles.

The magnetic carriers contain a magnetic substance. Examples of the magnetic substance include ferromagnetic metals, such as iron, cobalt, and nickel, alloys or compounds, such as ferrite, magnetite, and hematite containing ferromagnetic elements, such as iron, cobalt, and nickel. It is possible to use only one or two or more kinds of such magnetic substance in combination. Further, the magnetic substance may be one whose surface has been processed with silicone oil or the like.

It is preferable for the average particle size of the magnetic substance dispersion type carriers to range from 10 to 60 μm. When the average particle size is smaller than 10 μm, carriers will easily adhere to the photosensitive member, forming a flaw, etc., on the photosensitive member, which may lead to a cause of image deterioration. On the other hand, when the average particle size exceeds 60 μm, the share applied to the developer in the developing means increases to cause a deterioration in the developer, in particular, separation and change in configuration of the external additive of the toner particles, resulting in a deterioration in the image. Further, when the particle size is large, the specific surface area decreases, so that the amount of toner that can be retained in forming the developer is reduced, with the result that an image lacking vividness is likely to be formed.

It is preferable for the specific resistance for the magnetic substance dispersion type carriers to range from $10^7$ to $10^{15}$ Ω·cm. When the specific resistance is less than $10^7$ Ω·cm, electric current leaks from the developer carrying member (developing sleeve) to the photosensitive member surface in the developing range in the developing method in which bias voltage is applied, making it sometimes impossible to obtain a satisfactory image. On the other hand, when the specific resistance exceeds $10^{15}$ Ω·cm, a charge-up phenomenon occurs under such a condition as low humidity, which may lead to a deterioration in the image, such as low image density, defective transfer, or fog.

The average particle size of the magnetic carriers can be measured by various measuring methods; for example, the magnetic carriers are photographed as an electron microscope picture, and a predetermined number of the photographed carriers are extracted, calculating the arithmetic average of the maximum chord lengths of the extracted carriers. Further, the specific resistance of the magnetic carriers can be measured by various measuring methods, for example, a so-called tablet method. That is, the magnetic carriers constituting the object of measurement is put in an aluminum ring of 40 ϕ(mm), and pressure-shaped under 2,500 N, the specific resistance being measured by using a four-terminal probe with a resistance meter, such as Lorester AP or Highrester IP (both manufactured by Mitsubishi Chemical Corporation).

In this embodiment, the following was used as the two-component developer. That is, in this embodiment, the two-component developer is a mixture of a polymeric toner consisting of non-magnetic toner particles prepared by the suspension polymerization method, resin magnetic carriers prepared by polymerization, and polishing particles, the developer being prepared as four-color toner particles using the above-mentioned coloring agent in four colors. The T/D ratio, which is the ratio in weight of the toner particles to the sum of the toner particles and the magnetic carriers of the developer obtained, was 8%. The magnetic carriers exhibited a specific resistance of $10^{13}$ Ω·cm. Further, the non-magnetic polymeric toner was a substantially spherical toner with a smooth surface whose configuration coefficients SF-1 and SF-2 were 115 and 110, respectively, the toner having a weight average particle size of 8 μm, a specific gravity of 1.05 g/cm$^3$, and an average charge amount per unit mass of 25 μC/g. Further, the polishing particles consisted of alumina whose Mohs' hardness was 9, whose average particle size was 1.2 μm, and whose addition amount with respect to the non-magnetic toner particles was 1% by weight.

It is to be noted that the maximum image width in the image forming apparatus 100 of this embodiment is A4 landscape plus the over size corresponding length, which amounts to approximately 320 mm. Further, the peripheral velocity of the photosensitive member 2 in this embodiment is 300 mm/sec.

(General Operation of the Image Forming Apparatus)

Next, the general operation of the image forming apparatus 100 of this embodiment will be described.

In FIG. 1, light reflected from the original G placed on the original glass stand 10 is converted to electric signals of red (R), green (G), and blue (B) by the CCD 12 through the exposure system. An image processing system (IPS) converts the electric signals of R, G, and B input from the CCD 12 to image data of black (K), yellow (Y), magenta (M), and cyan (C) and stores it temporarily, outputting the image data with a predetermined timing to a laser drive circuit (not shown) as image data for latent image formation. The laser drive circuit outputs a laser drive signal to an ROS 13 according to the input image data.

The photosensitive member 2 rotates in the direction of the arrow Da in the drawing, and its surface is uniformly charged by the charger 1, and exposure scanning is performed at the latent image writing position A by the laser beam L (with a main wavelength of 655 nm) of the ROS 13 to form an electrostatic latent image. When forming a full color image, electrostatic latent images corresponding to images of the four colors of black (K), yellow (Y), magenta (M), and cyan (C) are successively formed, and, when forming a monochrome image, solely an electrostatic latent image corresponding to an image in black (K) is formed.

The writing for the latent images to the surface of the photosensitive member 2 with the laser beam L is started when a predetermined length of time has elapsed after the belt position sensor 41 detects a home position provided in a non-image portion of the intermediate transfer belt 40. In the case of a full color image, the respective colors are superimposed one upon the other, so that the requisite time from the detection of the home position by the belt position sensor 41 to the start of the writing of the latent image is the same for all the colors.

The surface of the photosensitive member 2 with electrostatic images formed thereon rotates and passes developing region B and primary transfer region D successively. The developing devices 31 through 34 are conveyed to the developing position with the rotation of the developing roller 4, turning the electrostatic latent images on the surface of the photosensitive member 2 passing the developing region B into toner images.

Here, referring also to FIG. 2, the developing process by the two-component magnetic brush method of this embodiment will be described. By way of example, the process for the black developing device 31 will be described. Similar operations are performed by the developing devices 32, 33, and 34 for the other colors. First, the developer scooped at the N2-pole of the magnet member as the developing sleeve 35*a* rotates is regulated, as it is conveyed successively by way of the S2-pole and the N1-pole, by the regulating blade 36*a* arranged perpendicular to the developing sleeve 35*a*, and a thin layer of developer is formed on the developing sleeve 35*a*. When the developer thus formed into a thin layer is conveyed to the developing main pole, the S1-pole, a magnetic brush is formed by magnetic force, forming a magnetic brush due to magnetic carriers on the developing sleeve 35*a*.

The developer thus formed into a magnetic brush rubs the surface of the photosensitive member 2. At this time, the toner particles are transferred to the photosensitive member 2 to develop the electrostatic latent image. The magnetic carriers forming the magnetic brush and the polishing particles are not positively transferred to the photosensitive member 2 but remain on the developing sleeve 35*a*. Thereafter, due to the repulsive magnetic field of the N3-pole and the N2-pole, the developer on the developing sleeve 35*a* is returned to the developer container 37*a*.

A DC voltage and an AC voltage from a power source (not shown) are applied to the developing sleeve 35*a*; in this embodiment, a DC voltage of −300 V and an AC voltage of Vpp=1,500 V, Vf=2,000 Hz are applied with respect to the photosensitive member surface potential (dark portion potential) of Vd (−450 V) and the exposure portion potential (light portion potential) of Vl (−50 V). Generally speaking, in the two-component developing method, application of AC voltage leads to an increase in developing efficiency and an improvement in image quality; on the other hand, it easily allows generation of fog. In view of this, fog is prevented by providing a difference in potential between the DC voltage applied to the developing sleeve 35*a* and the surface potential (dark portion potential) of the photosensitive member 2.

Further, in this embodiment, the developing sleeve 35*a* was rotated at a peripheral speed of 450 mm/sec in the counter direction (the opposite direction at the opposing portion) with respect to the rotation of the photosensitive member 2 in the direction of the arrow Da at a peripheral speed of 300 mm/sec. The rotation load torque of the developing sleeve 35*a* with respect to the surface of the photosensitive member 2 was 0.038 N·m. The rotation load torque as the rubbing function by the magnetic brush on the developing sleeve 35*a* with respect to the photosensitive member 2 preferably ranges from 0.02 to 0.06 N·m.

When forming a full color image, an electrostatic latent image in the first color is formed at the latent image writing position A and a toner image in the first color is formed in the developing region B. This toner image is primarily and electrostatically transferred onto the intermediate transfer belt 40 by the primary transferring roller 42 when passing the primary transfer region D. Thereafter, toner images in the second color, the third color, and the fourth color are similarly and primarily transferred successively one upon the other onto the intermediate transfer belt 40 bearing the toner image in the first color, eventually forming a full color multi-toner image on the intermediate transfer belt 40. When forming a monochrome image, for example, a black and white image, solely the developing device 31 is used, and a monochrome toner image is primarily transferred onto the intermediate transfer belt 40.

The transferring materials S accommodated in the tray 60 are extracted with a predetermined timing by the pick-up roller 61, and conveyed to the registration roller pair 62. In synchronism with the movement of the multi-toner image or the monochrome toner image primarily transferred to the intermediate transfer belt 40 to the secondary transfer region E, the registration rollers 62 conveys the transferring material S to the secondary transfer region E. The secondary transferring roller 48 secondarily transfers the toner image on the intermediate transfer belt 40, electrostatically and collectively, to the transferring material S.

The transferring material S to which the toner image has been secondarily transferred is conveyed to the fixing device 64 by the sheet transport belt 63, and the image is thermally fixed by the fixing device 64. The transferring material S to which the toner image has been fixed is discharged onto the discharge tray 65.

Incidentally, the toner remaining on the surface of the photosensitive member 2 after the primary transfer is removed by the cleaning blade 52 of the photosensitive member cleaner 50.

The toner remaining on the intermediate transfer belt 40 after the secondary transfer is removed by the cleaning blade 49*a* of the intermediate transfer member cleaner 49 when this cleaning blade 49*a* abuts the intermediate transfer belt by the operation of a cam mechanism (not shown) as a blade contact/separation means 491. In this way, the intermediate transfer belt 40 is cleaned. When multi-transfer is to be effected onto the photosensitive member, and transfer is to be directly effected to the transfer incurring material, the cleaning blade 52 of the photosensitive member cleaner 50 serving as the cleaner for the image bearing member abuts the photosensitive member through operation of the cam mechanism (not shown), and the toner is removed by this cleaning blade 52. In this way, the photosensitive member 2 is cleaned.

It is to be noted that the secondary transferring roller 48 and the intermediate transfer member cleaner 49 are arranged so as to be capable of separating from and coming into contact with the intermediate transfer belt 40. When forming a color image, the secondary transferring roller 48 and the intermediate transfer member cleaner 49 are kept away from the intermediate transfer belt 40 until the unfixed toner image in the final color is primarily transferred to the intermediate transfer belt 40. When multi-transfer is to be effected onto the photosensitive member and transfer is to be directly effected onto the transferring material to form a color image, the cleaning blade 52 of the photosensitive member cleaner 50 is kept away from the photosensitive member 2 until the unfixed toner image in the final color is transferred to the transferring material.

The timing with which the blade is separated or brought into contact is, as described above, such that the cleaning blade is kept away from the image bearing member until the unfixed toner image in the final color is transferred to the transferring material or the intermediate transfer member; however, this should not be construed restrictively. To achieve an increase in process speed, the timing may be set during image formation (during latent image formation, development, and transfer; or during latent image process in which the first through the final colors are superimposed one upon the other, during developing process, and during transfer process when a plurality of toners are to be superimposed one upon the other for image formation). In the present invention, the frictional force between the blade and the image bearing member is small, so that the image bearing member is relatively free from such influence as to fluctuate its speed due to fluctuation in load at the time of separation or contact.

For example, when the leading end of the image being formed is to be cleaned during the transfer of the unfixed toner image in the final color from the photosensitive member to the transferring material or the intermediate transfer member, the blade may abut the image bearing member during the transfer of the unfixed toner image in the final color to the transferring material or the intermediate transfer member. The abutment may be effected at any time as long as it is after the transferring roller or the secondary transferring roller 48 is abutted and before the leading end of the image passes the blade abutting portion. For example, the abutment is effected immediately after the secondary transferring roller is passed.

In the case of a construction in which during removal of the residual toner after secondary transfer, the transfer of the first color of the next image to the intermediate transfer member is started, the blade may be separated in the period from immediately after the completion of the cleaning during the transfer of the first color of the next image to the start of the transfer of the second color of the next image.

(Cleaning Member)

Next, as being most characteristic of the present invention, the cleaning member for removing matter adhering to the member to be cleaned in the image forming apparatus, will be described.

According to an aspect of the present invention, a cleaning blade as the cleaning member has a hardness of the first region of the blade coming into contact with the member to be cleaned, higher than a hardness of the second region of the blade retained by the retaining means. According to this construction, the deformation of the contact portion of the cleaning blade with the member to be cleaned can be reduced, so as to improve the durability of the cleaning blade against the shock upon the contact of the cleaning blade with the member to be cleaned in the case that, for example, the cleaning blade is contactable with and separable from the member to be cleaned, while the cleaning blade can effectively absorb the shock to prevent the vibrations. Furthermore, the wire edge of the cleaning blade caused by the uneven friction coefficient upon the contact of the cleaning blade with the member to be cleaned can be avoided. And, as described above, as the frictional force between the cleaning blade and the image bearing member can be reduced, the influence of the change in the speed of the image bearing member caused by the change in the load upon the contact and the separation can be reduced. More specifically, the cleaning blade is structured to comprise the first region including a portion contactable with the member to be cleaned and the second region including a portion retained by a retaining means, a temperature-dependent peak value of loss tangent tanδ of the second region being different from that of the first region.

Usually, the cleaning member consists of a plate-like member (blade member), that is, a cleaning blade due to its simple structure and since it allows a reduction in size and cost and is superior in adhesion matter removing function. A cleaning blade according to the present invention can be suitably used as the cleaning blades 52 and 49*a* for the photosensitive member cleaner 50 and the intermediate transfer member cleaner 49, with which the image forming apparatus 100 of this embodiment is equipped.

In obtaining the cleaning blade of the present invention, attention was focused on an urethane bond group with active hydrogen inherently present in polyurethane; the blade can be obtained by a production process in which an isocyanate compound and urethane are firmly bonded together through allophanate bonding and in which a surplus isocyanate compound not reacting with an active hydrogen compound is caused to undergo self polymerization.

This method allows formation of a surface-cured portion through impregnation with isocyanate without involving impregnation of an active hydrogen compound, so that the method is simple, takes a small number of steps, and is of low cost.

Further, the first portion including the portion in contact with the member to be cleaned, more specifically, the portion in the vicinity of the distal end of the cleaning blade (in particular, the edge portion in contact with the member to be cleaned (hereinafter simply referred to as the "edge portion")) is under low friction and is covered with the cured portion, so that deformation due to the friction with the associated object occurs to a small degree, and the edge portion always retains a sharp configuration, whereby a marked improvement in terms of performance is achieved regarding compatibility in cleaning performances for fine toner and spherical toner and, in particular, toners of different kinds.

In the following, this will be described in more detail.

(Blade Base Material)

Generally speaking, as the cleaning blade of an electrophotographic image forming apparatus, one using as the base material a polyurethane having a JIS-A hardness of 60 to 80 degrees as defined in JIS K 6253 can be suitably employed. The measurement conditions are 25° C. and 50% RH. Such a blade base material (blade member) is generally soft and exhibits a sufficient degree of rubber elasticity. As the polyurethane forming the blade base material of the cleaning blade of the present invention, it is possible to employ polymer polyol, polyisocyanate, and product of curing agent. When curing the blade base material, it is possible to use a catalyst usually employed to cure urethane.

While there are no particular limitations regarding the polymer polyol for forming the blade base material, it is possible to employ, for example, polyester polyol, polyether polyol, caprolactone ester polyol, polycarbonate ester polyol, or silicone polyol. The molecular weight that can be adopted usually ranges from 500 to 5,000.

While there are no particular limitations regarding the isocyanate for forming the blade base material, it is possible to adopt, for example, methane diphenyl diisocyanate (MDI), trilene diisocyanate, naphthalene diisocyanate, or hexamethylene diisocyanate.

Further, while there are no particular limitations regarding the crosslinking agent used for forming the blade base material, it is possible to employ, for example, 1,4-butanediol, 1,6-hexanediol, ethylene glycol, or trimethylol propane. Further, while there are no particular limitations regarding the catalyst for forming the blade base material, it is possible to use, for example, triethylene diamine.

To mold the blade base material, it is possible to employ (1) a one-shot method in which the above ingredients are mixed together at a time and poured into a mold or a centrifugal molding cylindrical mold for molding, (2) a pre-polymer method in which the isocyanate and the polyol are previously caused to react with each other to obtain a pre-polymer and then the crosslinking agent is mixed therewith before pouring the mixture into a mold or centrifugal molding cylindrical mold for molding, or (3) a semi-one-shot method in which a semi-pre-polymer obtained by reaction of the isocyanate with the polyol and a curing agent obtained by adding polyol to the crosslinking agent are caused to react with each other and the resultant material is poured into a mold or centrifugal molding cylindrical mold for molding.

Generally speaking, it is preferable for the cleaning blade thus molded has a JIS-A hardness of 60 to 85 degrees. When the JIS-A hardness is less than 60, the force with which it is brought into press contact with the associated object is rather weak; on the other hand, when the hardness exceeds 85 degrees, there is a possibility of the associated object being damaged.

(Impregnation/Hardening of the Isocyanate Compound)

The cleaning blade of the present invention can be prepared by a manufacturing method in which the blade base material thus molded is entirely or partially impregnated with an isocyanate compound and cured through heating, thereby forming a cured layer inwardly from the urethane surface.

The position at which the cleaning blade is impregnated with the isocyanate compound is at least the portion where the cleaning blade comes into contact with the member to be cleaned, for example, a toner bearing member (developer image bearing member) such as the photosensitive member or the intermediate transfer member, and further for allowance, it is preferable that the peripheral portion be also impregnated. That is, when the cleaning blade is sliding on the member to be cleaned, the portion thereof in contact with the member to be cleaned may be deformed due to rotation or movement of the member to be cleaned, and the portion which has been the peripheral portion of the contact portion when at rest may come into contact with the member to be cleaned. The larger the thickness of the portion impregnated with the isocyanate compound, the smaller the degree to which such deformation occurs during sliding, and, the larger the impregnation thickness, the smaller the deformation degree.

Figure 3A:
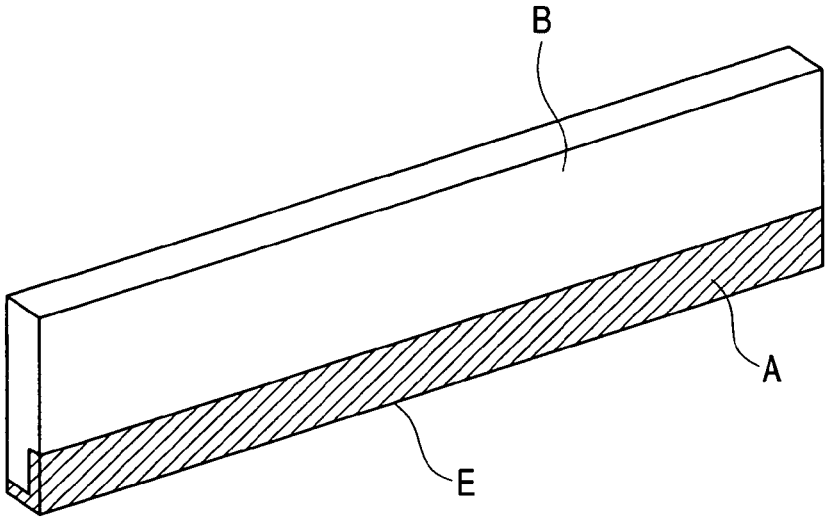
FIG. 3A is a perspective view schematically showing an embodiment of a typical cleaning blade according to the present invention.
Figure 3B:
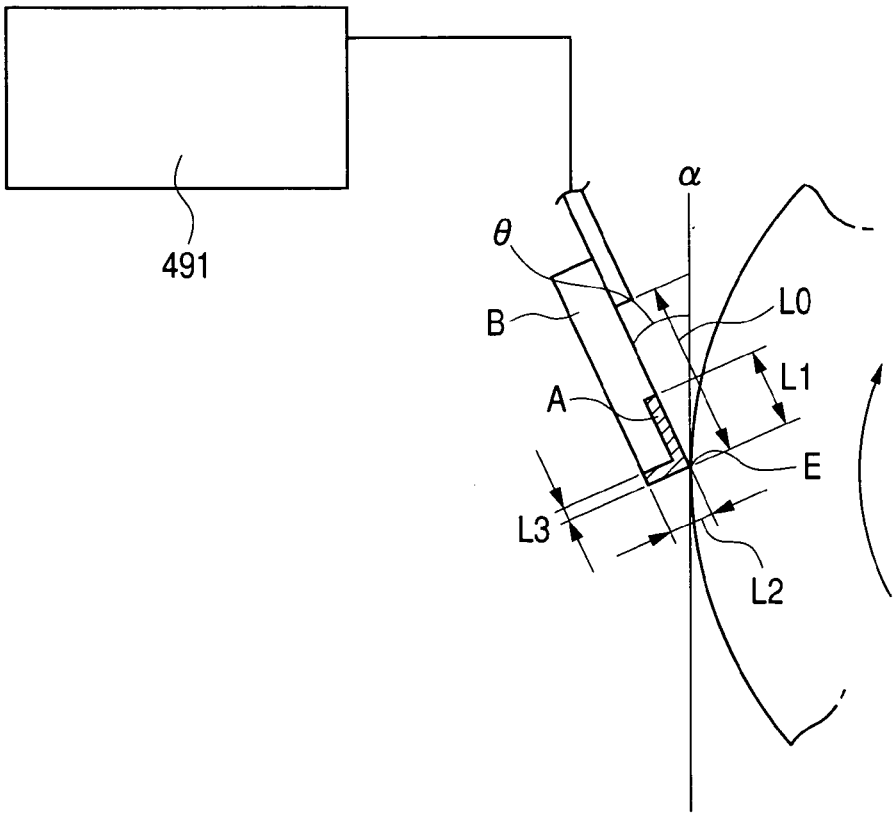
FIG. 3B is a side view schematically showing the cleaning blade.

As shown in FIGS. 3A and 3B, in this embodiment, there is provided an isocynate compound impregnated portion. Here, as shown in FIG. 3B, it is to be assumed that the free length of the cleaning blade (the distance from the forward end of the blade fixing portion to the distal end of the blade) is LO, that the length of the portion forming a cured portion through curing after the impregnation with the isocyanate compound (hereinafter referred to as the "processed portion") in the free length direction is L1, that the length in the cut surface direction (the blade thickness direction) is L2, and that the thickness of the impregnated layer is L3. In FIG. 3B, the processed portion of the cleaning blade (the first portion) is indicated by symbol A, the other portion thereof is indicated by symbol B, and the edge portion coming into contact with the member to be cleaned is indicated by symbol E.

When the length L1 of the processed portion reaches 80% or more of the free length L0, the cleaning blade as a whole becomes stiff to lose rubber elasticity, and the cleaning blade tends to deteriorate in followability with respect to the member to be cleaned. Further, the increase in the linear load with respect to the amount by which the cleaning blade approaches the member to be cleaned becomes abrupt, making it difficult to attain a stable linear load. Thus, it is preferable for the length L1 of the processed portion to be not more than 80%, and more preferably, not more than 70%, of the free length L0. Still more preferably, it is not more than 30% thereof. This makes it possible to ensure stability in followability and linear load of the cleaning blade with respect to the member to be cleaned.

It is preferable for the free length L0 to be not less than 0.5 mm but not more than 10 mm.

Further, it is preferable for the thickness of the blade (the length L2) to be not less than 0.5 mm but not more than 3.5 mm.

Figure 4A:
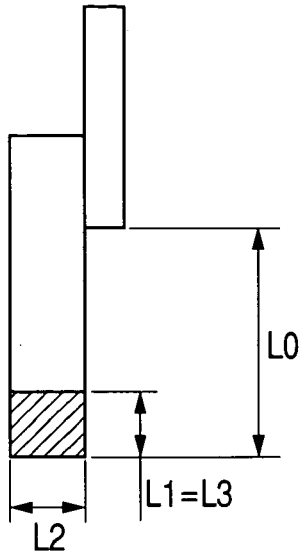
FIGS. 4A, 4B, 4C and 4D are side views schematically showing other embodiments of the typical cleaning blade according to the present invention.
Figure 4B:
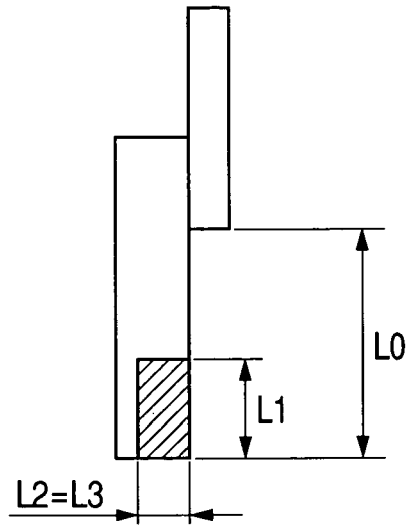

FIGS. 4A through 4D show some other examples of the way the isocyanate compound impregnated layer is provided. As shown in FIG. 4A, the thickness L3 of the impregnated layer may be equal to L1, and, as shown in FIG.

Figure 4C:
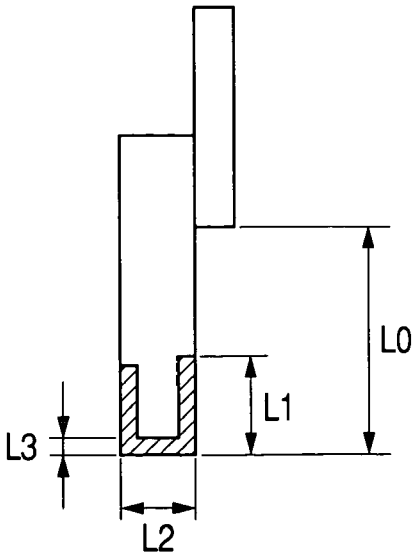
Figure 4D:
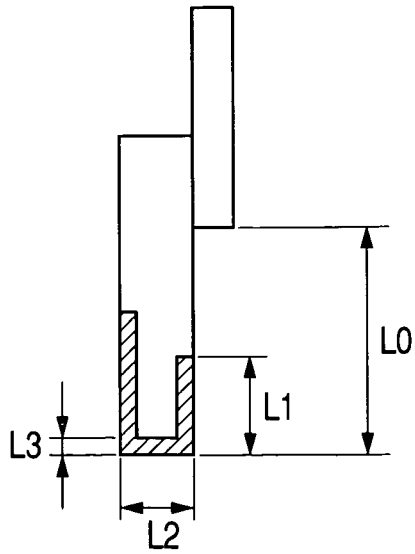

4B, equal to L2. Further, as shown in FIGS. 4C and 4D, it is also possible to provided an isocyanate compound impregnated layer also on the side opposite to the side opposed to the member to be cleaned; in this case, the length of that impregnated layer in the free length direction may be L1 or shorter or longer than that.

Here, L2 can be equal to the thickness of the cleaning blade at maximum.

Further, it is preferable for the thickness L3 of the cured portion formed by impregnating the blade base material with the isocyanate compound to be 0.12 mm or more. When the thickness L3 of the cured portion is less than 0.12 mm, wear resistance suffers. On the other hand, when the thickness L3 of the cured portion is more than 1.2 mm, the requisite time for impregnation becomes rather long, and the material isocyanate undergoes thermal deterioration, which is unpreferable from the viewpoint of practical use.

Thus, the thickness L3 of the processed portion preferably ranges from 0.12 to 1.2 mm. Usually, at the maximum, the lengths of the contact portion at the distal end of the cleaning blade are approximately as follows: L1=5.0 mm; and L2=2.0 mm.

As a method of impregnating the blade base material with the isocyanate compound, it is possible, for example, to adjust the temperature of a polyisocyanate compound to a level where it is liquid, and to immerse the blade base material therein. Further, it is possible to impregnate a fibrous or porous member with the isocyanate compound to coat the blade base material therewith. The coating may also be effected by spraying. During immersion in or during and after application of the isocyanate compound, it is preferable for the isocyanate compound to be at a temperature where it is liquid. In this way, urethane is impregnated with isocyanate compound, and after a fixed period of time has elapsed, the isocyanate compound remaining on the urethane surface is wiped off.

In impregnating a part of the cleaning blade with the isocyanate compound, it may be the blade member alone or a combination of the blade member and the support member thereof that undergoes impregnation. Further, it may also be in the form of a sheet prior to the cutting or slicing of the cleaning blade or a combination of the cleaning blade and the support member.

When only a part of the cleaning blade is to be impregnated with the isocyanate compound, masking is effected on the portion which should not be impregnated by using a chemical proof tape or the like, or only the portion to be impregnated is subjected to immersion.

The isocyanate compound with which the blade material is to be impregnated is one having one or more isocyanate group in a molecule. While in the present invention there are no particular limitations regarding the isocyanate compound with which the blade base material is to be impregnated, examples of the compound that can be adopted include the following ones.

Examples of a material having one isocyanate group include aliphatic monoisocyanates such as octadecylisocyanate and aromatic monoisocyanates.

Examples of a material having two isocyanate groups include 2,4-tolylene diisocyanate, 2,6-tolylene diisocyanate, 4,4'-diphenylmethane diisocyanate (MDI), m-phenylene diisocyanate, tetramethylene diisocyanate, hexamethylene diisocyanate, 4,4',4"-triphenylmethane triisocyanate, 2,4',4"-biphenylmethane diisocyanate, 2,4,4"-triphenylmethane diisocyanate.

Further, those each having three or more isocyanate groups and modified bodies and polymers of those each having two or more isocyanate groups may also be used.

Of those, from the viewpoint of permeability, aliphatic monoisocyanates with little steric hindrance and MDI with a low molecular weight are preferable.

As the multiplication catalyst to be used with the isocyanate compound, it is possible to adopt quaternary ammonium salt, carboxylic acid salt or the like. While such catalyst contains a hydroxyl group, its function is to polymerize the isocyanate, and is in itself unrelated to the bridge structure. When not dissolved in a solvent, such catalyst exhibits very high viscosity or is crystalline, so that it is preferable for the catalyst to be added to the isocyanate compound after being dissolved in a solvent. Specifically, examples of such catalyst include MEK, toluene, terathydrofuran, and ethyl acetate. The dilution ratio preferably ranges approximately from 1.5 times to 10 times.

The addition rate of the catalyst with respect to the isocyanate compound is preferably 1 ppm to 1,000 ppm. When the addition rate of the catalyst exceeds 1,000 ppm, there is a possibility of the catalyst not being dissolved in the solvent; on the other hand, when it is less than 1 ppm, the polymerization reaction takes time, and there is a possibility of the base rubber material being deteriorated. Further, when the isocyanate compound is mixed with the catalyst, the polymerization reaction is promoted, so that it is preferable for the mixing to be effected immediately before the impregnation. The lower limit of the temperature of the isocyanate compound at the time of impregnation may be one which keeps in the liquid state, and the upper limit thereof may be approximately 90° C. in order to prevent a deterioration of the isocyanate compound during the processing.

The surface of the blade base material is impregnated with the isocyanate compound through immersion or application for several minutes to several hours, and the surplus isocyanate compound is wiped off before performing heat treatment for several minutes to several hours in an atmosphere at 50 to 140° C. In the polyurethane structure, there is an urethane bond with an active hydrogen, which allows reaction with an isocyanate group. That is, through reaction with the active hydrogen of the urethane group in the polyurethane, an allophanate bond is generated to form a three-dimensional branching structure.

In an isocyanate compound having two or more isocyanate groups, polymerization reaction due to urea bond proceeds under the presence of water in the environment, and, together with the above-mentioned three-dimensional branching structure, a network structure is formed to form a cured portion.

In the case in which a multiplication catalyst is used, a multiplication reaction also proceeds due to its reaction. This reaction does not require the water in the environment, and the reaction takes place between the isocyanate groups, so that the reaction is characteristically completed quickly. Further, since a bridge structure is formed through trimeric reaction, the cured film exhibits a high level of strength, making it possible to produce a cleaning blade superior in durability.

In an isocyanate compound with one isocyanate group, when the isocyanate group reacts with the urethane group to form an allophanate bond, so that the free end is oriented toward the outer side of the polyurethane surface; thus, it is possible to prevent direct contact of the urethane with the surface of the member to be cleaned, thereby achieving a reduction in friction.

The smaller the molecular weight of the isocyanate compound, the higher the impregnability of the isocianate compound for the blade base material, making it easier to form a cured film with high isocynate density. Further, control is possible from one with a small layer thickness L3 to one with a large layer thickness L3. While one with a large molecular weight is inferior in impregnability, due to its long chain, the molecular chain protrudes from the polyurethane surface, and while the thickness of the cured portion is relatively small, it is effective in reducing frictional force. Those skilled in the art can appropriately select and use an isocyanate compound without departing from the scope of the present invention. Further, it is preferable for the cured portion to exhibit an international rubber hardness (IRHD) of 75 degrees to 100 degrees. This range makes it possible to realize a satisfactory durability of the blade and to prevent the toner bearing member from being damaged by the blade. The measurement conditions are 25° C. and 50% RH.

Figure 5:
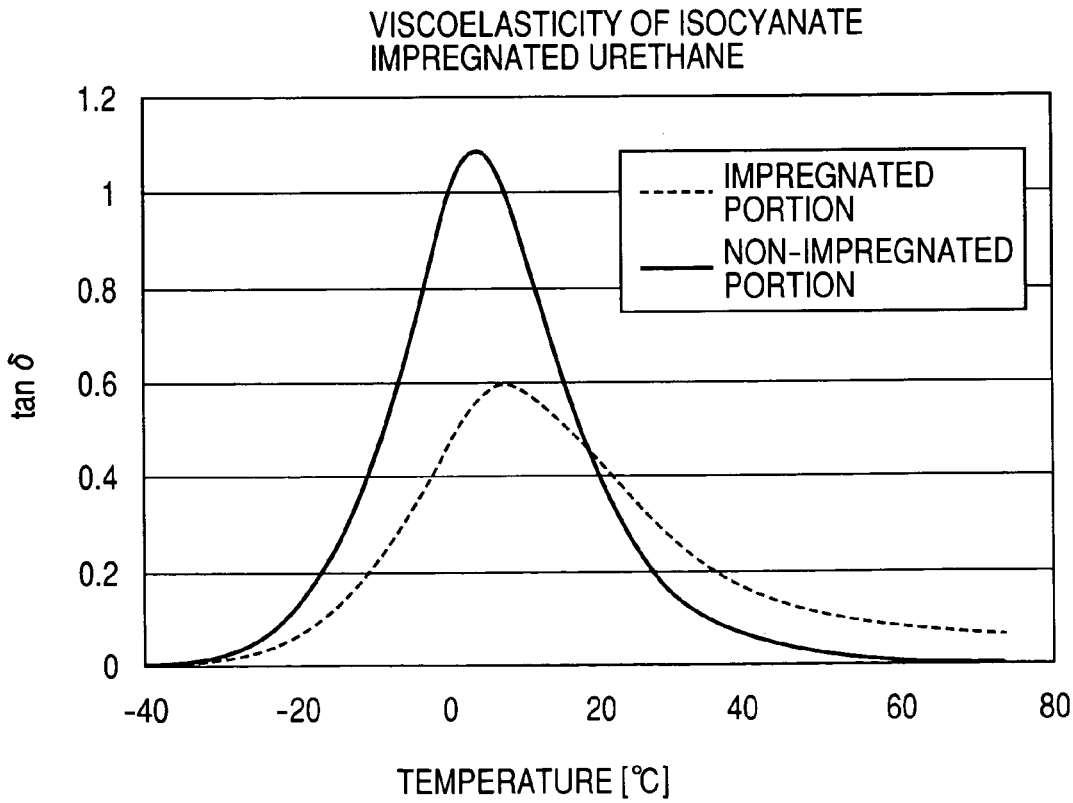
FIG. 5 is a graph showing viscoelasticity of the cleaning blade according to the present invention.

As described above, the blade base material is impregnated with the isocyanate compound and then cured to form a cured portion, whereby it is possible to obtain a cleaning blade exhibiting different peak values of tanδ (inner friction) indicating viscoelasticity between the portion A (the first portion) including the edge portion E in contact with the member to be cleaned and the remaining portion (the second portion) B (FIG. 5).

In this specification, the peak value of tanδ is a value measured as follows.

Exclusively the cured portion and exclusively the base material portion of the cleaning blade were respectively cut off, and, using a viscoelasticity measuring apparatus (dynamic viscoelasticity measuring apparatus) RSAII (manufactured by Rheometrics Far East Ltd.) (Soft; Rhios), the temperature dependency of tanδ was measured while effecting temperature rise from the low temperature side at a rate of 0.1° C./min. at a measurement frequency of 10 Hz. In FIG. 5, the spectrum obtained is shown by the solid line solely indicating the base material portion and the dashed line solely indicating the cured portion. Then, the tanδ peak temperature was measured. More specifically, the specimen (consisting of urethane rubber) was fixed at both ends to the measuring apparatus, and a tension of a fixed load was applied, and distortion was applied at a frequency of 10 Hz, measuring the stress generated in the specimen, decomposing it into an elastic stress, and, further, calculating therefrom a storage elastic modulus E' and a loss elastic modulus E"; the value obtained by dividing E" by E' was obtained as the value of tanδ; this measurement was effected while effecting temperature rise at a rate of 0.1° C./min. from low temperature region to high temperature region to measure the tanδ value at each temperature, obtaining the maximum temperature as the tanδ peak temperature. It is to be noted that the distortion applied to the specimen (formed of urethane rubber) is generated by applying a tension of ±ag at a period of 10 Hz to a previously applied tension; its value varies according to the measurement temperature and is set in an auto strain mode.

At least the portion of the cleaning blade of the present invention prepared as described above which abuts the member to be cleaned exhibits a coefficient of friction of 1.0 or less with respect to a PET (polyethylene terephthalate) film. When this coefficient of friction exceeds 1.0, the cleaning blade undergoes chattering/turn-up. More preferably, it is kept at 0.8 or less. Usually, this coefficient of friction is larger than 0.

In this specification, the coefficient of friction with respect to a PET film is a value. measured as follows.

A PET (polyethylene terephthalate) film (Toray Lumirror: type S10) exhibiting a static coefficient of friction of 0.6 and a dynamic coefficient of friction of 0.4 (ASTMD 1894) is fixed to the sample stand of a HEIDON 14 type surface measurement apparatus (manufactured by Shin-to Kagaku, Co.). A load (100 g) was applied from above to a specimen (a blade formed of polyurethane rubber (with a thickness of 2 mm, a width of 10 mm, and a length of 50 mm)) held at an angle of 45 degrees with respect to this flat film, and the sample stand was moved (at a rate of 50 mm/min.). The sample stand was moved in the forward direction with respect to the inclination of the specimen (in a direction opposite to the counter direction).

Next, the effect of the present invention will be described in more detail with reference to some specific examples (according to the present invention) and comparative examples.

EXAMPLE 1

In this example, in the above image forming apparatus 100, there is used, as the cleaning means for removing adhesion matter such as toner remaining after transfer process and paper dust from the intermediate transfer belt 40 constituting the member to be cleaned, a cleaning blade 49*a* with which the intermediate transfer member cleaner 49 is to be equipped, having a cured portion formed by curing processing after the impregnation with the isocyanate compound of the portion in the vicinity of the edge portion coming into contact with the intermediate transfer belt 40.

In this example, the cleaning blade 49*a* of the intermediate transfer member cleaner 49 was a blade base material of urethane prepared by mixing a crosslinking agent containing a triethylene diamine catalyst in which 1,4-butane diol and trimethylol propane are mixed together in a proportion by weight of 65:35 with a prepolymer whose NCO% is 7.0% produced from an ethylene butylene adipate type polyester polyol with a molecular weight of 2000 and 4,4-diphenyl methane diisocyanate such that the mole ratio of the hydroxyl-group/isocyanate-group is 0.9 (hardness: 70 degrees (JIS-A); repulsion elasticity: 15(%) (repulsion elasticity at 40° C.: 25%); 300% modulus: 200 (kg/cm$^2$) (as defined in JIS standards)).

Masking was effected on this blade base material with a chemical proof tape such that L1=3 mm and that L2=2 mm, and the material was immersed in an MDI bath at 80° C. for 30 minutes; the surplus isocyanate compound was wiped off, and the masking was removed, effecting curing for 60 minutes in an oven at 130° C.

The coefficient of friction with respect to a PET film of the edge portion of this cleaning blade 49*a* coming into contact with the intermediate transfer belt 40 was 0.6 (HEIDON surface tester/width: 50 mm, load: 20 g/10 mm, moving speed: 10 cm/min.). Further, the cured portion of the section was whitish, and the thickness L3 of the cured portion was 0.7 mm upon observation by an electron microscope. The hardness of the cured portion was 80 degrees (JIS-A).

Further, the peak value of tanδ of the processed portion including the edge portion of the cleaning blade 49*a* was 0.56, and the peak value of tanδ of the other portion was 1.20.

The cleaning blade 49*a* was held in contact with the intermediate transfer belt 40 at an abutment angle of 24 degrees, an abutment pressure of 25 (g/cm), and an abutment length (longitudinal length) of 330 mm. The thickness of the cleaning blade 49*a* was 2 mm, and the free length L0 was 8 mm. It is preferable for the abutment pressure of the cleaning blade to be not less than 5 g/cm, but not more than 70 g/cm. When it is less than 5 g/cm. defective cleaning occurs, and when it is more than 70 g/cm. the fluctuation in load due to the separation and abutment of the blade increases, resulting in generation of misregister of colors.

Figure 6:
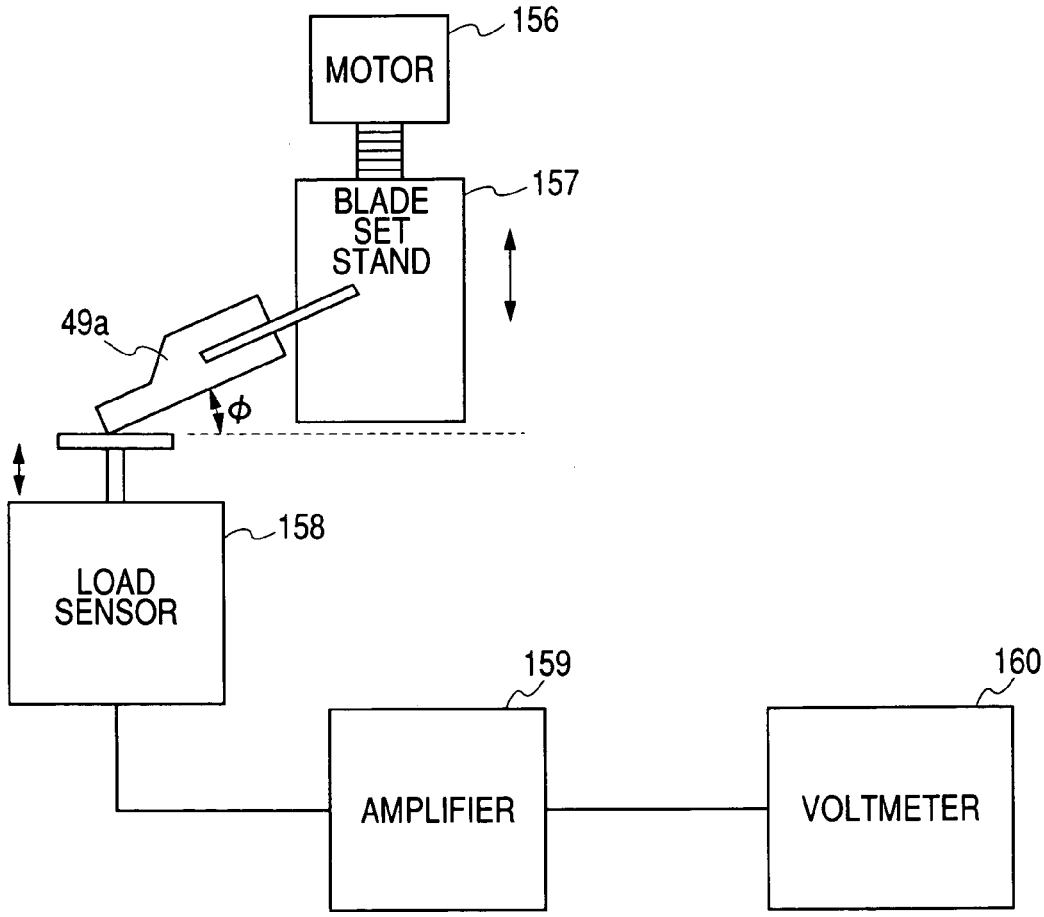
FIG. 6 is a view showing a method of measuring an abutment pressure of the cleaning blade.

A method of measuring the abutment pressure of the blade will hereinafter be described in conjunction with FIG. 6. First, in order to measure a linear load per unit length [cm], a blade 49*a* cut into a strip having a width of one centimeter (1 cm) is set on a blade stand 157, which can be moved by a motor 156 in the direction indicated by the arrow shown in FIG. 6. The blade 49*a* is set at a desired set angle Φ within the range from about 10° to 35° and brought into contact with a load sensor 158. Then, the blade stand 157 is moved toward the load sensor 158 by a desired inroad amount, and at that time a detection value of the load sensor 158 is amplified by an amplifier 159 so that the detection value is read by a voltmeter 160. The detection value is converted into a linear load per unit length (per one centimeter) on the basis of a pre-calculated load per unit voltage. The value measured as describe above is referred to as the blade abutment pressure.

It is preferable for the angle at which the blade abuts the member to be cleaned to be not less than 10 degrees but not more than 35 degrees in the counter direction.

Here, the abutment angle refers to the angle θ made by the tangent α at the abutment portion of the member to be cleaned and the cleaning blade when imaginarily regarded as not deformed; when the cleaning blade is deflected, it is defined as the angle made by the tangent α of the member to be cleaned at the point where the imaginary outer periphery of the member to be cleaned and the cleaning blade are in contact with each other and by the tangent of the cleaning blade.

By using the above-described image forming apparatus 100, image formation was performed in a high-temperature/high-humidity (32.5° C./85%) environment and a room-temperature/low-humidity (23° C./5%) environment. Then, the cleaning performance of the intermediate transfer member cleaner 49 was evaluated.

As a result, even after an endurance test on 1 million sheets, there were no problems such as misregister of colors due to the attachment/detachment of the cleaning blade 49*a* to and from the intermediate transfer belt 40, chipping of the edge portion of the cleaning blade 49*a*, and defective cleaning of the intermediate transfer belt 40.

EXAMPLE 2

In this example, the cleaning blade 49*a* of the intermediate transfer member cleaner 49 was obtained by using as the blade base material an urethane rubber having a hardness of 70 degrees (JIS-A) and a repulsion elasticity of 35% and processing the edge portion coming into contact with the intermediate transfer belt 40 by a curing method similar to that of Example 1. The coefficient of friction with respect to a PET film of the edge portion of this cleaning blade 49*a* coming into contact with the intermediate transfer belt 40 was 0.4. The thickness L3 of the cured portion was 0.5 mm. Further, the peak value of tanδ of the processed portion including the edge portion of the cleaning blade 49*a* was 0.4, and the peak value of tanδ of the other portion was 1.0.

Regarding the intermediate transfer member cleaner 49, evaluation similar to that in Example 1 was made. As a result, even after an endurance test on 1 million sheets, there were no problems in the images such as misregister of colors due to the attachment and detachment of the cleaning blade 49*a* to and from the intermediate transfer belt 40 and rubbing flaws on the surface of the intermediate transfer belt 40, nor were there problems such as chipping of the edge portion of the cleaning blade 49*a* and defective cleaning of the intermediate transfer belt 40.

EXAMPLE 3

In this example, an intermediate transfer belt 40 whose surface roughness had been adjusted to Rz 0.5 in 10-point average roughness was used in the image forming apparatus 100. The coefficient of friction of the surface of the intermediate transfer belt 40 was 0.22 (HEIDON tribogear muse TYPE: 94B). Otherwise, this example was of the same construction as Example 1. Regarding the intermediate transfer member cleaner 49, evaluation similar to that of Example 1 was made.

As a result, even after an endurance test on 1 million sheets, there were no problems in the images such as misregister of colors due to the attachment and detachment of the cleaning blade 49*a* to and from the intermediate transfer belt 40 and rubbing flaws on the surface of the intermediate transfer belt 40, nor were there problems such as chipping of the edge portion of the cleaning blade 49*a* and defective cleaning of the intermediate transfer belt 40.

COMPARATIVE EXAMPLE 1

The cleaning blade 49*a* of this comparative example was prepared in the same manner as the cleaning blade 49*a* of Example 1. However, in this example, the cleaning blade 49*a* was immersed for five minutes in an MDI bath, and the surplus isocyanate was wiped off before effecting curing in an oven at 130° C. for 60 minutes. The thickness L3 in section of the cured layer was 0.1 mm.

The coefficient of friction with respect to a PET film of the edge portion of the cleaning blade 49*a* of this example, measured in the same manner as in Example 1, was 2.5. The peak value of tanδ of the processed portion including the edge portion of the cleaning blade 49*a* was 0.7, and the peak value of tanδ of the other portion was 1.2. Regarding the intermediate transfer member cleaner 49 an endurance test was conducted in the same manner as in Example 1. As a result, defective cleaning occurred after image formation on 500,000 sheets.

COMPARATIVE EXAMPLE 2

In this example, the same urethane rubber as that of Example 2 was used without performing the processing of forming a surface-cured portion through impregnation with an isocyanate compound. The coefficient of friction with respect to a PET film of the edge portion of the cleaning blade 49*a* of this example, measured in the same manner as in Example 1, was 2.7. Regarding the intermediate transfer member cleaner 49 an endurance test was conducted in the same manner as in Example 1. As a result, defective cleaning due to chipping of the cleaning blade occurred after image formation on 300,000 sheets.

As described above, by providing the cleaning blade 49*a* of the present invention on the intermediate transfer member cleaner 49, it is possible to prevent an increase in the frictional force between the surface of the intermediate transfer belt 40 and the cleaning blade 49*a*, making it possible to maintain an appropriate surface condition of the intermediate transfer member to thereby substantially improve the image forming apparatus in terms of reliability.

Further, the blade of the present invention is also applicable when there is a marked improvement on the part of the image forming apparatus in terms of image productivity.

That is, with the cleaning blade 49*a* of the present invention, independently of whether it is a magnetic toner or a non-magnetic toner that is employed, it is possible to prevent problems such as an increase in the frictional force between the intermediate transfer belt 40 and the cleaning blade 49*a* through endurance running, adhesion or fusion bonding of toner, and misregister of colors; even when a polymerized toner or a toner with small particle size is used, problems such as slipping through of the toner are prevented, making it possible to prevent damage to the cleaning blade 49*a* and intermediate transfer belt 40. Thus, it is possible to achieve an improvement in the reliability of the intermediate transfer belt 40 and the cleaning blade 49*a*, making it possible to form high quality images for a long period of time.

Next, comparing some specific examples (according to the present invention), in which the cleaning member of the present invention is used as the cleaning blade 52 of the photosensitive member cleaner 50, with comparative examples, the effects of the present invention will be discussed in detail.

EXAMPLE 4

In this example, in the above image forming apparatus 100, there is used, as the cleaning means for removing adhesion matter such as toner remaining after transfer process and paper dust from the photosensitive member 2 constituting the member to be cleaned, the cleaning blade 52 with which the photosensitive member cleaner 50 is to be equipped, having a cured portion formed by curing processing after the impregnation with the isocyanate compound of the portion in the vicinity of the edge portion coming into contact with the photosensitive member 2.

In this example, the cleaning blade 52 of the photosensitive member cleaner 50 was a blade base material of urethane prepared by mixing a crosslinking agent containing a triethylene diamine catalyst in which 1,4-butane diol and trimethylol propane are mixed together in a proportion by weight of 65:35 with a prepolymer whose NCO% is 7.0% produced from an ethylene butylene adipate type polyester polyol with a molecular weight of 2000 and 4,4'-diphenyl methane diisocyanate such that the mole ratio of the hydroxyl-group/isocyanate-group is 0.9 (hardness: 70 degrees (JIS-A); repulsion elasticity: 15(%) (repulsion elasticity at 40° C.: 25%); 300% modulus: 200 (kg/cm$^2$) (as defined in JIS standards)).

Masking was effected on this blade base material with a chemical proof tape such that L1=3 mm and that L2=2 mm, and the material was immersed in an MDI bath at 80° C. for 30 minutes; the surplus isocyanate compound was wiped off, and the masking was removed, effecting curing for 60 minutes in an oven at 130° C.

The coefficient of friction with respect to a PET film of the edge portion of this cleaning blade 52 coming into contact with the photosentive member 2 was 0.6 (HEIDON surface tester/width: 50 mm, load: 20 g/10 mm, moving speed: 10 cm/min.). Further, the cured portion of the section was whitish, and the thickness L3 of the cured portion was 0.7 mm upon observation by an electron microscope. The hardness of the cured portion was 80 degrees (JIS-A).

Further, the peak value of tanδ of the processed portion including the edge portion of the cleaning blade 52 was 0.55, and the peak value of tanδ of the other portion was 1.1.

The cleaning blade 52 was held in contact with the photosensitive member 2 at an abutment angle of 24 degrees, an abutment pressure of 20 (g/cm), and an abutment length (longitudinal length) of 320 mm. The thickness of the cleaning blade 52 was 2 mm, and, as a back plate, there was arranged an SUS plate (with a thickness of 1.0 mm). The free length of the cleaning blade was 8 mm.

Using the above image forming apparatus 100, image formation was performed in a high-temperature/high-humidity (32.5° C./85%) environment. Then, the cleaning performance of the photosensitive member cleaner 50 was evaluated.

It is to be noted that in this example and the following Examples 5 and 6 and Comparative Examples 3 and 4, there is used, as the intermediate transfer belt 40, one with a double layer structure consisting of a polyimide layer and a cyanoresin layer (high dielectric constant layer). This intermediate transfer belt 40 is a seamless belt which is manufactured in the same manner as described above and which has a surface specific resistance of $10^{12}$ Ω/□, a volume resistivity of $10^{10}$ Ω·cm, and a thickness of 75 μm.

As a result, after image formation on 3 million sheets and even in a high-temperature/high-humidity environment, no smeared image was generated. Further, no problems such as chipping occurred in the edge portion of the cleaning blade 52.

Then, upon inspection of the photosensitive member 2 after the endurance test of 3million sheets, there were no image problems, such as fusion bonding of toner, partial filming generation, and rubbing flaws. Further, the wear amount of the surface of the photosensitive member 2 was an appropriate value of 0.12 nm/1000 rev. Further, the photosensitive member 2 which had undergone an endurance test of 3 million sheets was heated in a 5% aqueous solution of sodium peroxodisulfate ($Na_2S_2O_8$) (for 30 minutes at 70 to 80° C.), subjected to ultrasonic cleaning in acetone (for approximately 1 minute), and measured, before and after rinsing in ethanol/pure-water, by a reflection spectroscopic interferometer (MCDP 2000 manufactured by Otsuka Electronics Co., Ltd.), with the result that no filming layer was discerned.

EXAMPLE 5

In this example, the cleaning blade 52 of the photosensitive member cleaner 50 was obtained by using as the blade base material an urethane rubber having a hardness of 70 degrees (JIS-A) and a repulsion elasticity of 35% and processing the edge portion coming into contact with the photosensitive member 2 by a curing method similar to that of Example 4. The coefficient of friction with respect to a PET film of the edge portion of this cleaning blade 52 coming into contact with the photosensitive member 2 was 0.38. The thickness L3 of the cured portion was 0.3 mm. Further, the peak value of tanδ of the processed portion including the edge portion of the cleaning blade 52 was 0.5, and the peak value of tanδ of the other portion was 1.0. Regarding the photosensitive member cleaner 50, evaluation similar to that in Example 4 was made.

As a result, after the endurance test on 3 million sheets, there were no such image problems, such as toner fusion bonding on the photosensitive member 2, partial generation of filming layer, and rubbing flaws, and no filming layer was to be discerned.

EXAMPLE 6

In this example, there was used a photosensitive member 2 in which, instead of SiC:H, a-C:H (amorphous carbon hydride) was laminated to a thickness of 1000 Å. Otherwise, this example is of the same construction as Example 4.

Investigation by the present inventors has shown that amorphous carbon hydride has a smaller coefficient of friction as compared with the surface layer of SiC:H conventionally used. The Vickers hardness of the surface of the photosensitive member 2 of this example was (1100 $Kg/m^2$).

Regarding the photosensitive member cleaner 2, an endurance test similar to that in Example 4 was conducted. As a result, even after an endurance test on 3 million sheets in a high-temperature/high-humidity (32.5° C./85%) environment, no smeared image was generated. Also, no such problems as chipping of the edge portion of the cleaning blade 52 were observed. Further, even after an endurance test on 3 million sheets, there were no such image problems, such as toner fusion bonding on the photosensitive member 2, partial generation of filming layer, and rubbing flaws, and no filming layer was to be discerned.

Further, the wear amount of the photosensitive member 2 in this example was 0.02 Å/1000 rev. Further, the coefficient of friction after the endurance test was smaller as compared with that of the SiC:H surface layer. It is to be assumed that this is due to the fact that since the surface free energy of amorphous carbon hydride is smaller than that of SiC:H, organic substances, such as ozone product, toner, and paper dust, do not easily adhere to the surface of the photosensitive member 2, with the result that a filming layer is not easily formed.

COMPARATIVE EXAMPLE 3

In this example, a cleaning blade was prepared in the same manner as in the preparation of the cleaning blade 52 described with reference to Example 4. However, in this example, the cleaning blade 52 was immersed in an MDI bath, the surplus isocyanate compound was wiped off, and curing was effected for 60 minutes in an oven at 130° C. The thickness L3 of the cured layer in section was 0.1 mm.

The coefficient of friction with respect to a PET film of the edge portion of the cleaning blade 52 of this example, measured in the same manner as in Example 4, was 1.5. Further, the peak value of tanδ of the processed portion including the edge portion of the cleaning blade 52 was 0.7, and the peak value of tanδ of the other portion was 1.0. With respect to the photosensitive member cleaner 50, an endurance test similar to that of Example 4 was conducted. As a result, defective cleaning occurred after the initial stage of the endurance test on 300,000 sheets.

COMPARATIVE EXAMPLE 4

In this example, an urethane rubber similar to that of Example 4 was used without performing the processing of impregnation with isocyanate compound to form a surface-cured portion. The coefficient of friction with respect to a PET film of the edge portion of the cleaning blade 52 of this example, measured in the same manner as in Example 4, was 3.0. Regarding the photosensitive member cleaner 50, an endurance test similar to that of Example 4 was conducted. As a result, toner fusion bonding occurred after an endurance test on 50,000 sheets.

As described above, by providing the cleaning blade 52 of the present invention in the photosensitive member cleaner 50, it is possible, independently of whether it is a magnetic toner or a non-magnetic toner that is used as the developer, to maintain the surface of the photosensitive member 2 in a state in which no smeared image or toner fusion bonding is generated, making it possible to achieve a substantial improvement of the image forming apparatus 100 in terms of reliability. Further, the cleaning blade is also applicable to a case in which there is a marked improvement of the image forming apparatus in image productivity.

That is, in the cleaning blade 52 of the present invention, it is possible to prevent adhesion of paper dust or corona product, which leads to generation of filming on the photosensitive member 2 after endurance running, so that even in a full color image forming apparatus using a two-component developer, it is possible to prevent a deterioration in image quality such as smeared image attributable to filming generation. Further, it is possible to prevent an increase in the frictional force between the photosensitive member 2 and the cleaning blade 52, cohesion or fusion bonding of toner, and damage to the cleaning blade 52 and the photosensitive member 2, making it possible to improve the photosensitive member 2 and the cleaning member in terms of reliability and to form high quality images for a long period of time.

Further, after careful study, the inventors of the present invention have found that when, in particular, abutment is effected in the counter direction with respect to the member to be cleaned, it is preferable that, in a cleaning blade having a first portion including the portion in contact with the member to be cleaned and a second portion whose peak value of tanδ is different from that of the first portion, the average dynamic coefficient of friction of the cleaning blade, the surface of the member to be cleaned, and the adhesion matter on the surface of the member to be cleaned be not more than 1.2; this construction makes it possible, in particular, to prevent slipping-through of toner, etc. when the member to be cleaned is an intermediate transfer member, thereby maintaining the surface of the member to be cleaned in a satisfactory state for a long period of time and preventing damage to the cleaning blade and the member to be cleaned to thereby achieve an improvement in terms of reliability. When the average dynamic coefficient of friction of these three exceeds 1.2, chattering/turn-up/chipping may occur to the cleaning blade. More preferably, it is set to 1.0 or less. Further, to ensure the requisite scraping force for the counter blade, it is preferable for the average dynamic coefficient of friction of these three to be not less than 0.1.

The average dynamic coefficient of friction of these three is, for example, a value obtained through measurement as follows.

Measurement is performed in an image forming apparatus which has a cleaning blade and a photosensitive member as a member to be cleaned and which actually forms toner images. That is, in a state in which toner exists on the photosensitive member surface, the following measurement is performed. (More specifically, there is formed on an image bearing member a test chart image in which line scale and gray scale coexist and whose image ratio is 5%; thereafter, measurement is performed, with the transfer residual toner remaining on the image bearing member after image transfer being removed). The vertical force N (N) with which the cleaning blade is pressed against the photosensitive member and the frictional force F(N) generated from the friction with the blade when the photosensitive member rotates are measured, and calculation is performed by the following equation:

$$\text{Coefficient of friction } \mu = F/N$$

Here, the frictional force F is expressed by the equation: $F=T2-T1/\gamma$, where T1 is the rotation torque (N·m) of the image bearing member itself, T2 is the rotation torque (N·m) when the cleaning blade is pressed with the force N in a direction perpendicular to the photosensitive member, and $\gamma$ is the radius (m) of the image bearing member. When the image bearing member is an intermediate transfer member, there is formed on an image bearing member test chart images in the respective colors in which line scale and gray scale coexist and whose image ratio is 5%; thereafter, the images are superimposed one upon the other and transferred to the intermediate transfer member, performing measurement, with the transfer residual toner remaining on the intermediate transfer member after secondary image transfer being removed.

In the following, the effects of the present invention will be described in detail with reference to some specific examples (according to the present invention) and comparative examples.

EXAMPLE 7

In this example, the cleaning blade 49*a* of the intermediate transfer member cleaner 49 was a blade base material of urethane prepared by mixing a cross linking agent containing a triethylene diamine catalyst in which 1,4-butane diol and trimethylol propane are mixed together in a proportion by weight of 65:35 with a prepolymer whose NCO% is 7.0% produced from an ethylene butylene adipate type polyester polyol with a molecular weight of 2000 and 4,4'-diphenyl methane diisocyanate such that the mole ratio of the hydroxyl-group/isocyanate-group is 0.9 (hardness: 70 degrees (JIS-A); repulsion elasticity: 15(%) (repulsion elasticity at 40° C.: 25%); 300% modulus: 200 (kg/cm$^2$) (as defined in JIS standards)).

Masking was effected on this blade base material with a chemical proof tape such that L1=3 mm and that L2=2 mm, and the material was immersed in an MDI bath at 80° C. for 30 minutes; the surplus isocyanate was wiped off, and the masking was removed, effecting curing for 60 minutes in an oven at 130° C.

The coefficient of friction with respect to a PET film of the edge portion of this cleaning blade 49*a* coming into contact with the intermediate transfer belt 40 was 0.6 (HEIDON surface tester/width: 50 mm, load: 20 g/10 mm, moving speed: 10 cm/min.). Further, the cured portion of the section was whitish, and the thickness L3 of the cured portion was 0.7 mm upon observation by an electron microscope. The hardness of the cured portion was 80 degrees (JIS-A).

Further, the peak value of tanδ of the processed portion including the edge portion of the cleaning blade 49*a* was 0.45, and the peak value of tanδ of the other portion was 1.0.

The cleaning blade 49*a* was held in contact with the intermediate transfer belt 40 at an abutment angle of 24 degrees, an abutment pressure of 25 (g/cm), and an abutment length (longitudinal length) of 330 mm. The thickness of the cleaning blade 49*a* was 2 mm, and the free length of the cleaning blade 49*a* was 8 mm.

Further, the average dynamic coefficient of friction of the cleaning blade 49*a*, the surface of the intermediate transfer belt 40, and the adhesion matter (residual matter) on the surface of the intermediate transfer belt 40 after secondary transfer was 0.7.

By using the above-described image forming apparatus 100, image formation was performed in a high-temperature/high-humidity (32.5° C./85%) environment and a room-temperature/low-humidity (23° C./5%) environment. Then, the cleaning performance of the intermediate transfer member cleaner 49 was evaluated.

As a result, even after an endurance test on 1 million sheets, there were no problems such as misregister of colors due to the attachment and detachment of the cleaning blade 49*a* to and from the intermediate transfer belt 40, chipping of the edge portion of the cleaning blade 49*a*, and defective cleaning of the intermediate transfer belt 40.

EXAMPLE 8

In this example, the cleaning blade 49*a* of the intermediate transfer member cleaner 49·was obtained by using as the blade base material an urethane rubber having a hardness of 70 degrees (JIS-A) and a repulsion elasticity of 35% and processing the edge portion coming into contact with the intermediate transfer belt 40 by a curing method similar to that of Example 7.

The average dynamic coefficient of friction of the cleaning blade 49*a*, the surface of the intermediate transfer belt 40, and the adhesion matter (residual matter) on the surface of the intermediate transfer belt 40 after secondary transfer was 0.8. Further, the peak value of tanδ of the processed portion including the edge portion of the cleaning blade 49*a* was 0.5, and the peak value of tanδ of the other portion was 1.0. Regarding the intermediate transfer member cleaner 49, evaluation similar to that in Example 7 was made.

As a result, even after an endurance test on 1 million sheets, there were no problems in the images such as misregister of colors due to the attachment and detachment of the cleaning blade 49*a* to and from the intermediate transfer belt 40 and rubbing flaws on the surface of the intermediate transfer belt 40, nor were there problems such as chipping of the edge portion of the cleaning blade 49*a* and defective cleaning of the intermediate transfer belt 40.

EXAMPLE 9

The average dynamic coefficient of friction of the cleaning blade 49*a*, the surface of the intermediate transfer belt 40, and the adhesion matter (residual matter) on the surface of the intermediate transfer belt 40 after secondary transfer was 0.8. Further, the peak value of tand of the processed portion including the edge portion of the cleaning blade 49*a* was 0.5, and the peak value of tand of the other portion was 1.0. Regarding the intermediate transfer member cleaner 49, an evaluation similar to that in Example 7 was made.

As a result, even after endurance test on 1 million sheets, there were no problems in the images such as misregister of colors due to the attachment and detachment of the cleaning blade 49*a* to and from the intermediate transfer belt 40 and rubbing flaws on the surface of the intermediate transfer belt 40, nor were there problems such as chipping of the edge portion of the cleaning blade 49*a* and defective cleaning of the intermediate transfer belt 40.

COMPARATIVE EXAMPLE 5

The cleaning blade 49*a* of this comparative example was prepared in the same manner as the cleaning blade 49*a* of Example 7. However, in this example, the cleaning blade 49*a* was immersed for five minutes in an MDI bath, and the surplus isocyanate was wiped off before effecting curing in an oven at 130° C. The thickness L3 in section of the cured layer was 0.1 mm. In this example, the average coefficient of friction of the cleaning blade 49*a* in the actual apparatus, the surface of the intermediate transfer belt 40, and the adhesion matter (residual matter) on the surface of the intermediate transfer belt 40 after secondary transfer was 1.4. Regarding the intermediate transfer member cleaner 49 an endurance test was conducted in the same maimer as in Example 7. As a result, defective cleaning occurred after image formation on 300,000 sheets.

COMPARATIVE EXAMPLE 6

In this example, the same urethane rubber as that of Example 8 was used without performing the processing of forming a surface-cured portion through impregnation with an isocyanate compound. In this example, the average coefficient of friction of the cleaning blade 49*a* in the actual apparatus, the surface of the intermediate transfer belt 40, and the adhesion matter (residual matter) on the surface of the intermediate transfer belt 40 after secondary transfer was 1.8. Regarding the intermediate transfer member cleaner 49, an endurance test was conducted in the same manner as in Example 7. As a result, defective cleaning due to chipping of the cleaning blade 49*a* occurred after image formation on 300,000 sheets.

COMPARATIVE EXAMPLE 7

In this example, by the surface roughness of the cylindrical mold for molding the intermediate transfer belt 40, the surface roughness Rz of the intermediate transfer belt 40 was adjusted to 5.0. Otherwise, this example is of the same construction as that of Example 7. In this example, the average coefficient of friction of the cleaning blade 49*a* in the actual apparatus, the surface of the intermediate transfer belt 40, and the adhesion matter (residual matter) on the surface of the intermediate transfer belt 40 after secondary transfer was 0.7; regarding the intermediate transfer member cleaner 49 an endurance test was conducted in the same manner as in Example 7, with the result that slipping through toner in the intermediate transfer member cleaner 49 occurred even in the early stage.

As described above, it is also possible to prevent an increase in the frictional force between the surface of the intermediate transfer belt 40 and the cleaning blade 49*a* and to maintain an appropriate surface state of the intermediate transfer member to thereby substantially improve the image forming apparatus in terms of reliability also by forming, in particular, the cleaning blade 49*a* counter-abutting the intermediate transfer belt 40, a cured portion by curing process after impregnation of the portion in the vicinity of the edge portion coming into contact with the intermediate transfer belt 40 with an isocyanate compound. Further, this blade is also applicable to a case where there is a marked improvement of the image forming apparatus in terms of image productivity. While in the above-described example the member to be cleaned is the intermediate transfer belt 40, the same construction also provided a satisfactory result in the case in which the member to be cleaned was the photosensitive member 2.

The above description of the specific examples of the present invention should not be construed restrictively. It is naturally possible to apply a cleaning member according to the present invention to both the cleaning blade 52 with which the photosensitive member cleaner 50 is equipped and the cleaning blade 49*a* with which the intermediate transfer member cleaner 49 is equipped.

As described above, according to the present invention, it is possible to avoid an impact upon the contact of the blade with the image bearing member, the wear of the blade due to the frictional force or the like imparted by the image bearing member, or the vibrations in the image bearing member caused by the impact upon the contact of the blade with the image bearing member when the cleaning blade is attached or detached, that is, when the cleaning blade is brought into contact with or separated from the image bearing member. In this way, in accordance with the present invention, it is possible to achieve an improvement in terms of cleaning performance for the surfaces of members to be cleaned in an image forming apparatus, such as an electrophotographic photosensitive member and an intermediate transfer member, making it possible to form high quality images for a long period of time, whereby the image forming apparatus is substantially improved in terms of reliability and it is also possible to cope with a marked improvement of the image forming apparatus in terms of image productivity.

What is claimed is:

1. An image forming apparatus comprising:

toner image forming means for forming a toner image on an image bearing member;

an intermediate transfer member, which bears a toner image transferred from said image bearing member and has a surface layer having a releasing ability;

a cleaning blade including, a plate-shaped base member having an elasticity and a hardening-processed portion in which an end portion of said base member extending from a face of said base member on a side of said intermediate transfer member to a face opposite to said face is hardening-processed with an isocyanate compound, said cleaning blade being configured to clean toner on said intermediate transfer member by said hardening-processed portion abutting against said surface layer, a hardness of said hardening-processed portion being higher than a hardness of said base member, and a dynamic coefficient of friction of said hardening-processed portion with respect to polyethylene terephthalate, which has a dynamic coefficient of friction of 0.4, being larger than 0 and not larger than 1.0; and cleaning blade abutting means for making said cleaning blade, which is separated from said intermediate transfer member, abut against said intermediate transfer member during a rotation of said intermediate transfer member, an abutment pressure of said cleaning blade being not less than 5 g/cm but not more than 70 g/cm.

2. An image forming apparatus according to claim 1, wherein the dynamic coefficient of friction is larger than 0 and not larger than 0.8.

3. An image forming apparatus according to claim 1, wherein a length of said hardening-processed portion is not larger than 70% of an entire free length of said cleaning blade.

4. An image forming apparatus according to claim 1, wherein a length of said cleaning hardening-processed portion is not larger than 30% of an entire free length of said cleaning blade.

5. An image forming apparatus according to claim 1, wherein a peak value of tan δ of said hardening-processed portion is lower than a peak value of tan δ of said base member.

6. An image forming apparatus according to claim 1, wherein a JIS-A hardness of said hardening-processed portion is not less than 75° and not larger than 100°, and a JIS-A hardness of said base member is not less than 60° and not larger than 85°.

* * * * *

UNITED STATES PATENT AND TRADEMARK OFFICE

CERTIFICATE OF CORRECTION

PATENT NO. : 7,254,364 B2
APPLICATION NO. : 10/851182
DATED : August 7, 2007
INVENTOR(S) : Yuji Nakayama It is certified that error appears in the above-identified patent and that said Letters Patent is hereby corrected as shown below:

COLUMN 3:
Line 9, "problem. It is not oniy" should read --problem. ¶ It is not only--.

COLUMN 6:
Line 1, "apparatus) First," should read --apparatus) ¶ First,--.

COLUMN 10:
Line 28, "mage" should read --image--.

COLUMN 16:
Line 62, "pheyl" should read --phenyl--.

COLUMN 17:
Line 51, "perpxide" should read --peroxide--; and

COLUMN 18:
Line 32, "monozaometallic" should read --monoazometallic--.

COLUMN 28:
Line 39, "is an" should read --is a--.

COLUMN 31:
Line 21, "describe" should read --described--.

COLUMN 34:
Line 50, "is an" should read --is a--.

COLUMN 35:
Line 55, "is an" should read --is a--.

COLUMN 38:
Line 13, "49·was" should read --49 was--;
Line 14, "material an" should read --material a--.
Line 43, "tand" should read --tanδ--; and
Line 45, "tand" should read --tanδ--.

UNITED STATES PATENT AND TRADEMARK OFFICE

CERTIFICATE OF CORRECTION

PATENT NO. : 7,254,364 B2
APPLICATION NO. : 10/851182
DATED : August 7, 2007
INVENTOR(S) : Yuji Nakayama It is certified that error appears in the above-identified patent and that said Letters Patent is hereby corrected as shown below:

COLUMN 39:
Line 4, “maimer” should read --manner--.

COLUMN 40:
Line 52 claim 3, “cleaning” should read deleted.

Signed and Sealed this

Twentieth Day of May, 2008

JON W. DUDAS
*Director of the United States Patent and Trademark Office*